US008611804B2

(12) United States Patent
Watanabe

(10) Patent No.: US 8,611,804 B2
(45) Date of Patent: Dec. 17, 2013

(54) IMAGE FORMING APPARATUS

(75) Inventor: Osamu Watanabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 374 days.

(21) Appl. No.: 12/979,716

(22) Filed: Dec. 28, 2010

(65) Prior Publication Data

US 2011/0091247 A1 Apr. 21, 2011

Related U.S. Application Data

(63) Continuation of application No. 12/000,499, filed on Dec. 13, 2007, now Pat. No. 7,945,201.

(30) Foreign Application Priority Data

Dec. 20, 2006 (JP) ..... 2006-342201

(51) Int. Cl.
*G03G 21/00* (2006.01)

(52) U.S. Cl.
USPC ..... 399/351

(58) Field of Classification Search
USPC ..... 399/264
See application file for complete search history.

(56) References Cited

U.S. PATENT DOCUMENTS

| | | | |
|---|---|---|---|
| 7,031,634 | B2 | 4/2006 | Ziegelmuller et al. |
| 2001/0009618 | A1 | 7/2001 | Ohgoshi et al. |
| 2004/0033094 | A1 | 2/2004 | Saito et al. |
| 2004/0170450 | A1 | 9/2004 | Hamano et al. |
| 2005/0078991 | A1 | 4/2005 | Kimura et al. |
| 2006/0204297 | A1 | 9/2006 | Honda et al. |

FOREIGN PATENT DOCUMENTS

| | | |
|---|---|---|
| JP | 2001-134144 | 5/2001 |
| JP | 2004-077607 | 3/2004 |
| JP | 2004-348005 | 12/2004 |

*Primary Examiner* — Marcus Taningco
(74) *Attorney, Agent, or Firm* — Kubotera & Associates, LLC

(57) ABSTRACT

An image forming apparatus includes a transportation member rotating to transport a medium or developer; a blade member disposed to abut against the transportation member for removing an object adhering to a surface of the transportation member; and a retaining member disposed on an upstream side of the blade member in a direction that the transportation member rotates and abutting against the transportation member for retaining the object adhering to the surface of the transportation member.

19 Claims, 17 Drawing Sheets

IMAGE FORMING APPARATUS

CROSS-REFERENCE TO RELATED APPLICATIONS

This is a continuation application of the prior application Ser. No. 12/000,499 filed Dec. 13, 2007 now U.S. Pat. No. 7,945,201.

BACKGROUND OF THE INVENTION

The present invention relates to an image forming apparatus having a blade member for removing toner remaining on a surface of a toner supporting member.

In a conventional image forming apparatus for forming an image through a photoelectric method such as a printer, a copier, a fax machine, and a multifunction product thereof, an LED (Light Emitting Diode) head exposes a surface of a photosensitive drum to form a static latent image. A developing device develops the static latent image to form a toner image, and a transfer device transfers the toner image to a sheet. A fixing device fixes the toner image on the sheet, thereby forming an image. After the toner image is transferred, a blade or a cleaning device removes toner remaining on the surface of the photosensitive drum.

In the conventional image forming apparatus, a transportation belt or a toner supporting member for transporting the sheet is disposed to contact with the photosensitive drum. Accordingly, toner adheres also to a surface of the transportation belt, and the blade or the cleaning device removes toner remaining on the surface of the transportation belt as well. In this case, the blade abuts against the surface of the transportation belt or the toner supporting member to scrape off toner, thereby cleaning the surface of the toner supporting member (refer to Patent Reference).

Patent Reference; Japanese Patent Publication No. 2004-77607

In the conventional image forming apparatus, when an image is continuously formed, a contact portion of the blade abutting against the surface of the toner supporting member may be curled up. FIG. 2 is a view showing a blade of a conventional image forming apparatus.

As shown in FIG. 2, a blade 202 abuts against a surface of a transportation belt 201. A sheet is placed on an area 203 of the transportation belt 201. In a printing operation, toner adheres to the area 203 of the transportation belt 201 in a different manner from that in other areas where the sheet is not placed. Accordingly, the blade 202 slides against the transportation belt 201 at a boundary between the area 203 and the other area in significantly different conditions. As a result, when the printing operation is performed continuously on sheets having a same size, portions 205 of the blade 202 abutting against side edges of the sheet 203 on the transportation belt 201 tend to be curled up.

In view of the problems described above, an object of the invention is to provide an image forming apparatus capable of preventing a blade member from being curled up. In the image forming apparatus, a blade member is provided for removing toner remaining on a toner supporting member, and a toner retaining member is disposed on a upstream side of the blade member in a transportation direction for retaining toner remaining on the toner supporting member. Accordingly, it is possible to stably supply toner to a portion of the toner supporting member contacting with the blade member, thereby stabilizing a friction load between the toner supporting member contacting with the blade member.

Further objects and advantages of the invention will be apparent from the following description of the invention.

SUMMARY OF THE INVENTION

In order to attain the objects described above, according to the present invention, an image forming apparatus includes a transportation member rotating to transport a medium or developer; a blade member disposed to abut against the transportation member for removing an object adhering to a surface of the transportation member; and a retaining member disposed on an upstream side of the blade member in a direction that the transportation member rotates and abutting against the transportation member for retaining the object adhering to the surface of the transportation member.

Accordingly, it is possible to effectively supply the developer to an abutting surface between the transportation member and the blade member, thereby stabilizing a frictional load between the transportation member and the blade member, and preventing the blade member from being curled up.

DETAILED DESCRIPTION OF PREFERRED EMBODIMENTS

Hereunder, embodiments of the present invention will be explained with reference to the accompanying drawings.

First Embodiment

Figure 1:
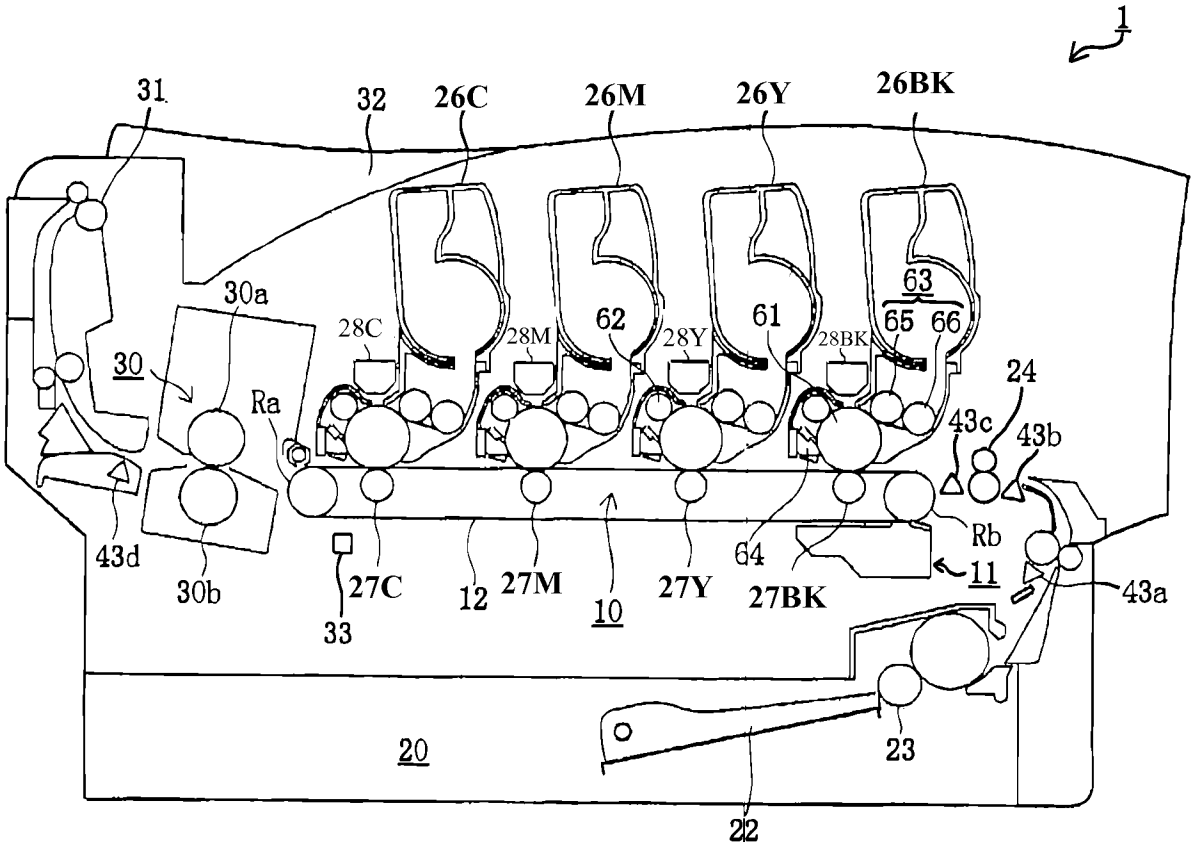
FIG. 1 is a schematic view showing an image forming apparatus according to a first embodiment of the present invention.
Figure 2:
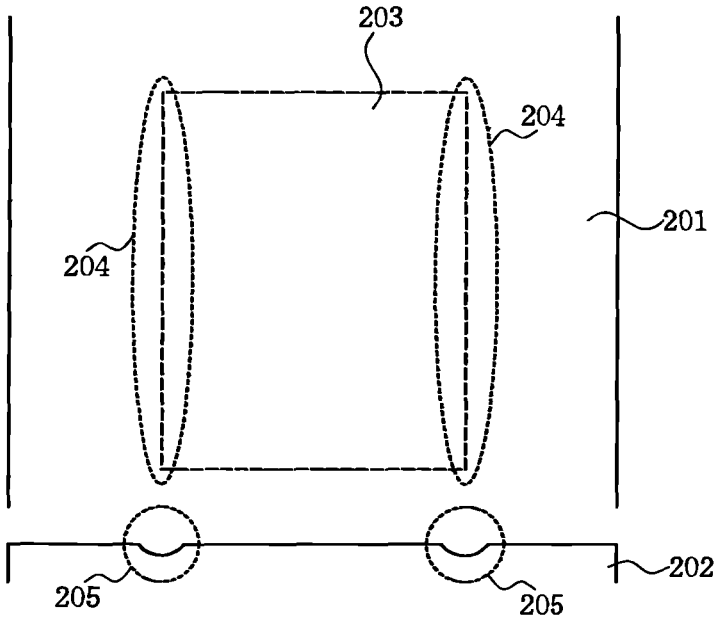
FIG. 2 CONVENTIONAL ART
FIG. 2 is a schematic view showing a blade in a conventional image forming apparatus.

A first embodiment of the present invention will be explained. FIG. 1 is a schematic view showing an image forming apparatus 1 according to a first embodiment of the present invention. As shown in FIG. 1, the image forming apparatus 1 includes four image forming units 26BK, 26Y, 26M, and 26C, and a fixing device 30 as a fixing unit. The image forming apparatus 1 includes a printer, facsimile, a copier, and the likes, and forms a monochrome image or a color image on a medium such as a print sheet, an envelope, an OHP (Over Head Projector) sheet, and the likes.

In the embodiment, the image forming units 26BK, 26Y, 26M, and 26C are provided for forming toner images, and the fixing device 30 fixes the toner images to a medium. The image forming apparatus 1 may form a monochrome image or a color image. In the specification, the image forming apparatus 1 is a color printing apparatus of a tandem type. In the image forming apparatus 1, the image forming units 26BK, 26Y, 26M, and 26C corresponding to black (BK), yellow (Y), magenta (M), and cyan (C) are arranged in this order along a direction (left direction in FIG. 1) that a medium is transported.

In the embodiment, the image forming apparatus 1 includes a medium storage portion 20 at a lower portion thereof. The medium storage portion 20 includes a medium cassette 22 for storing a sheet as a medium. A supply roller 23 picks up a sheet from the medium cassette 22 one by one, and then the sheet is transported to a register roller 24. At this time, the register roller 24 is in an idle state, thereby temporarily stopping the sheet. Then, the register roller 24 rotates to transport the sheet to a transportation belt 12 of a transportation belt unit 10.

When the sheet is transported to the transportation belt 12, a suction device (not shown) applies static charge to the sheet, so that the transportation belt 12 sticks and transports the sheet. At this time, in the image forming units 26BK, 26Y, 26M, and 26C, LED (Light Emitting Diode) heads 28BK, 28Y, 28M, and 28C form static latent images on surfaces of photosensitive drums 61, and developing devices 63 develop the static latent images, thereby forming toner images in black (BK), yellow (Y), magenta (M), and cyan (C).

In the next step, transfer rollers 27BK, 27Y, 27M, and 27C transfer the toner images in black (BK), yellow (Y), magenta (M), and cyan (C) from the surface of the photosensitive drums 61 to the sheet through static charge, thereby forming a color image. After the toner images are transferred to the sheet, the sheet is transported to the fixing device 30, so that the sheet passes through between a heating roller 30*a* and a pressing roller 30*b* of the fixing device 30. Accordingly, the color image is fixed to the sheet, thereby recording the color image.

After the color image is fixed to the sheet, a discharge roller 31 transports and discharges the sheet to a stacker 32 disposed at an upper portion of the image forming apparatus 1. Medium sensors 43*a*, 43*b*, 43*c*, and 43*d* are disposed along a transportation path of the sheet for detecting the sheet passing therethrough.

In the embodiment, each of the image forming units 26BK, 26Y, 26M, and 26C includes the photosensitive drum 61 as a toner supporting member or an image supporting member; a charging roller 62 or a charging device for constantly and uniformly charging the photosensitive drum 61; the developing device 63 for developing the static latent image formed on the surface of the photosensitive drum 61 with each of the LED heads 28BK, 28Y, 28M, and 28C to form the toner image in each color; and a cleaning device 64 for removing toner remaining on the surface of the photosensitive drum 61.

In the embodiment, the developing device 63 includes a developing roller 65 as a toner supporting member contacting with the photosensitive drum 61, and a toner supply roller 66 for supplying toner to the developing roller 65. The LED heads 28BK, 28Y, 28M, and 28C are arranged above the image forming units 26BK, 26Y, 26M, and 26C, so that the LED heads 28BK, 28Y, 28M, and 28C face the surfaces of the photosensitive drums 61.

In the embodiment, the transportation belt unit 10 includes the transportation belt 12 formed in an endless belt as a toner supporting member or a transportation member; a drive roller or a first roller Ra; a follower roller or a second roller Rb; the transfer rollers 27BK, 27Y, 27M, and 27C; and a waste toner box portion 11 disposed below the follower roller Rb. The drive roller Ra and the follower roller Rb extend the transportation belt 12 with specific tension. A belt drive motor 49 drives the transportation belt 12 to rotate. In the transportation belt unit 10, the transfer rollers 27BK, 27Y, 27M, and 27C are arranged below and face the image forming units 26BK, 26Y, 26M, and 26C.

In the embodiment, an image detection sensor 33 is disposed adjacent to the drive roller Ra for detecting information related to color shift. More specifically, the image forming units 26BK, 26Y, 26M, and 26C form toner images as test patterns on the transportation belt 12, and the image detection sensor 33 optically detects the test patterns for color shift correction. The image detection sensor 33 is formed of a light emitting element and a light receiving element. The light emitting element irradiates the test patterns on the transportation belt 12, and the light receiving element detects light reflected from the test patterns to send a voltage signal according to light intensity.

Figure 3:
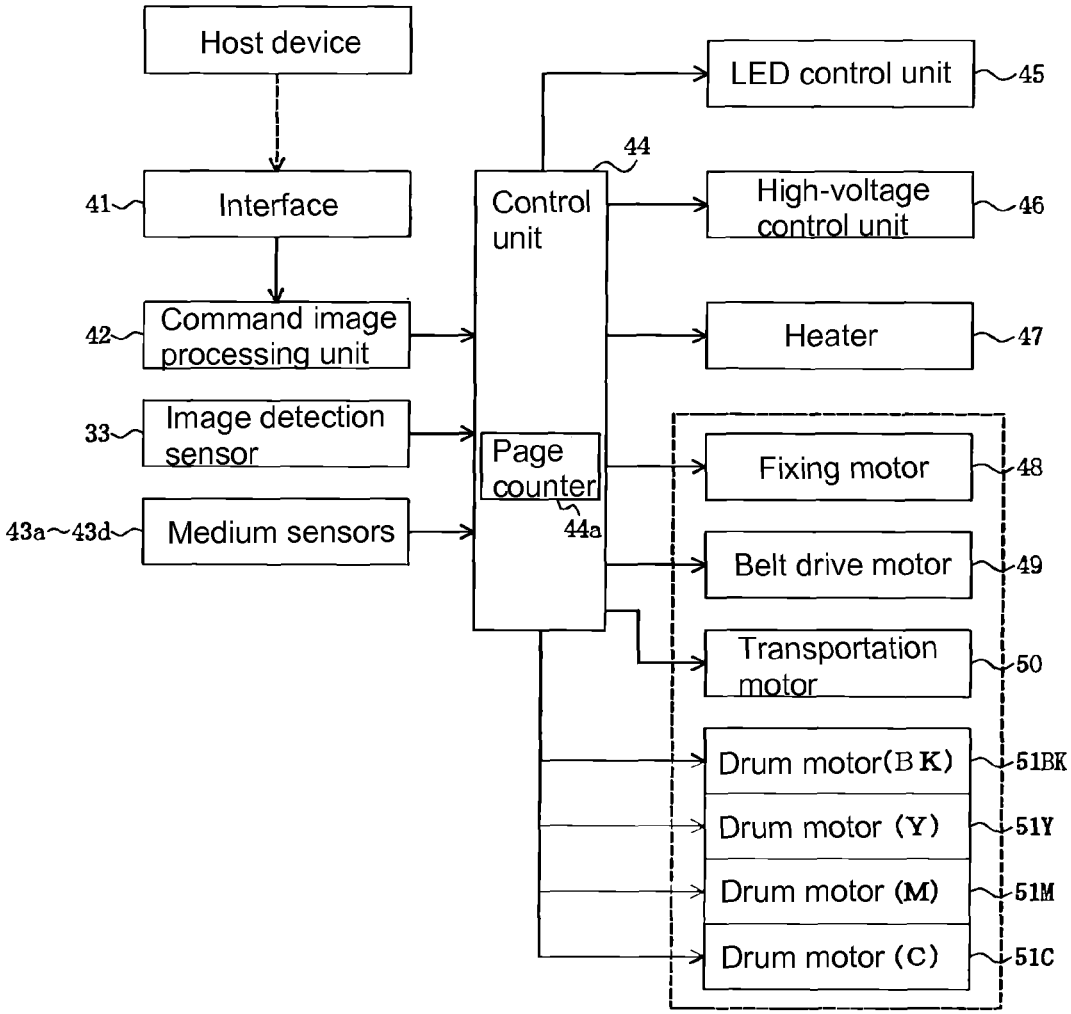
FIG. 3 is a block diagram showing a control system of the image forming apparatus according to the first embodiment of the present invention.

A control system of the image forming apparatus 1 will be explained next. FIG. 3 is a block diagram showing the control system of the image forming apparatus 1 according to the first embodiment of the present invention. As shown in FIG. 3, the image forming apparatus 1 includes a control unit 44 connected to a command image processing unit 42, in addition to the image detection sensor 33 and the medium sensors 43*a* to 43*d*. The command image processing unit 42 processes a command and image data input from a host device through an interface 41.

In the embodiment, the control unit 44 is connected to and controls an LED control unit 45; a high-voltage control unit 46; and a heater 47. The LED control unit 45 controls the LED heads 28BK, 28Y, 28M, and 28C provided in the image forming units 26BK, 26Y, 26M, and 26C, respectively.

Further, the control unit 44 controls a fixing motor 48 for driving the heating roller 30*a* and the pressing roller 30*b*; the belt drive motor 49 for driving the drive roller Ra; a transportation motor 50 for driving the sheet supply roller 23 and the likes; and drum motors 51BK, 51Y, 51M, and 51C for driving the photosensitive drums 61 provided in the image forming units 26BK, 26Y, 26M, and 26C, respectively.

In the embodiment, the control unit 44 further includes a page counter 44*a* for counting a page number of image data to be processed. The command image processing unit 42 processes the image data per page to generate print data. The page counter 44*a* increases a count value every time the image data are processed per page. According to the count value of the page number counted with the page counter 44*a*, the control unit 44 determines a timing when a coat toner image 103 or a test pattern for color shift correction is formed on the transportation belt 12.

Figure 4:
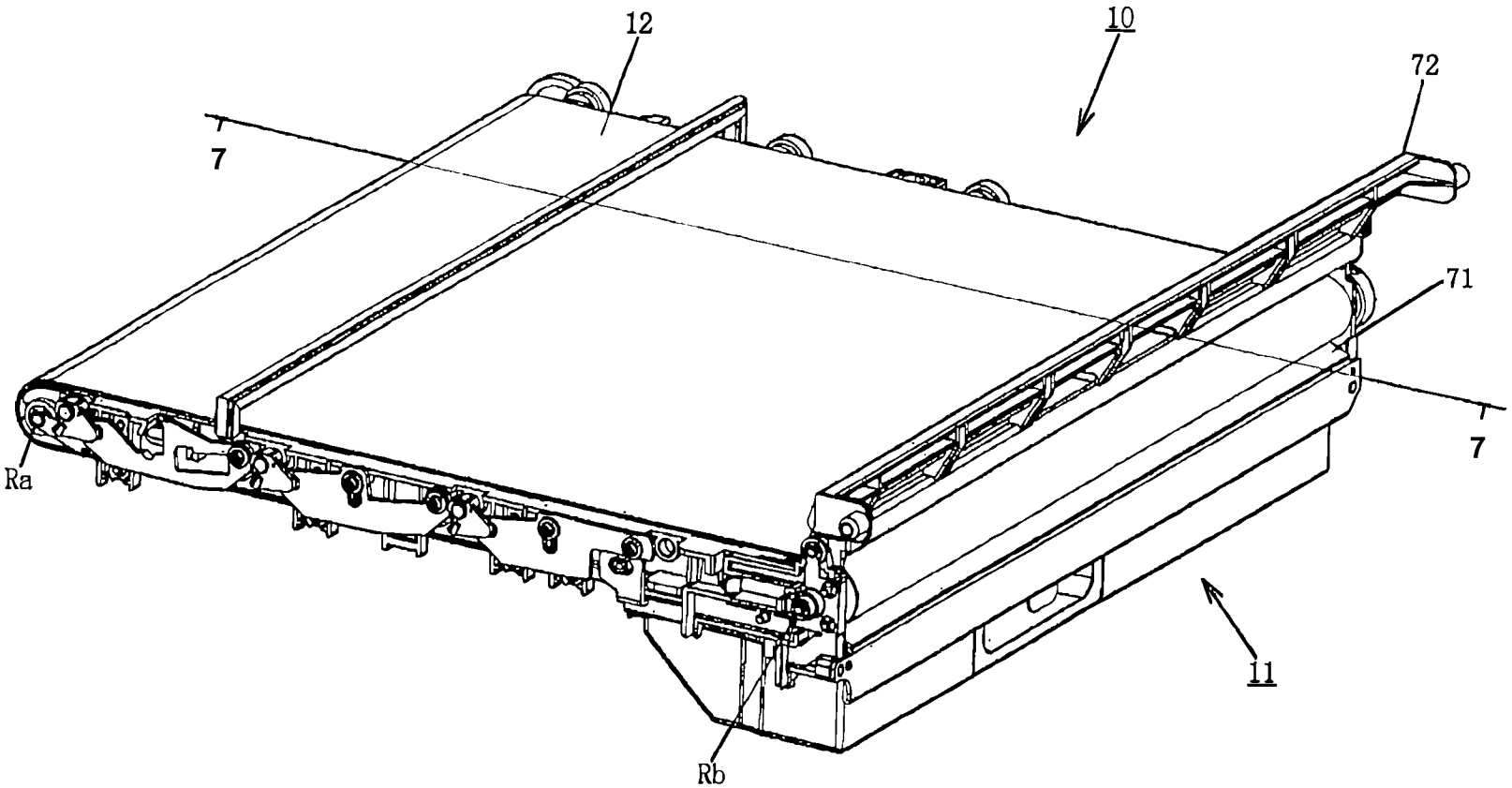
FIG. 4 is a perspective view showing a transportation belt unit of the image forming apparatus according to the first embodiment of the present invention.
Figure 5:
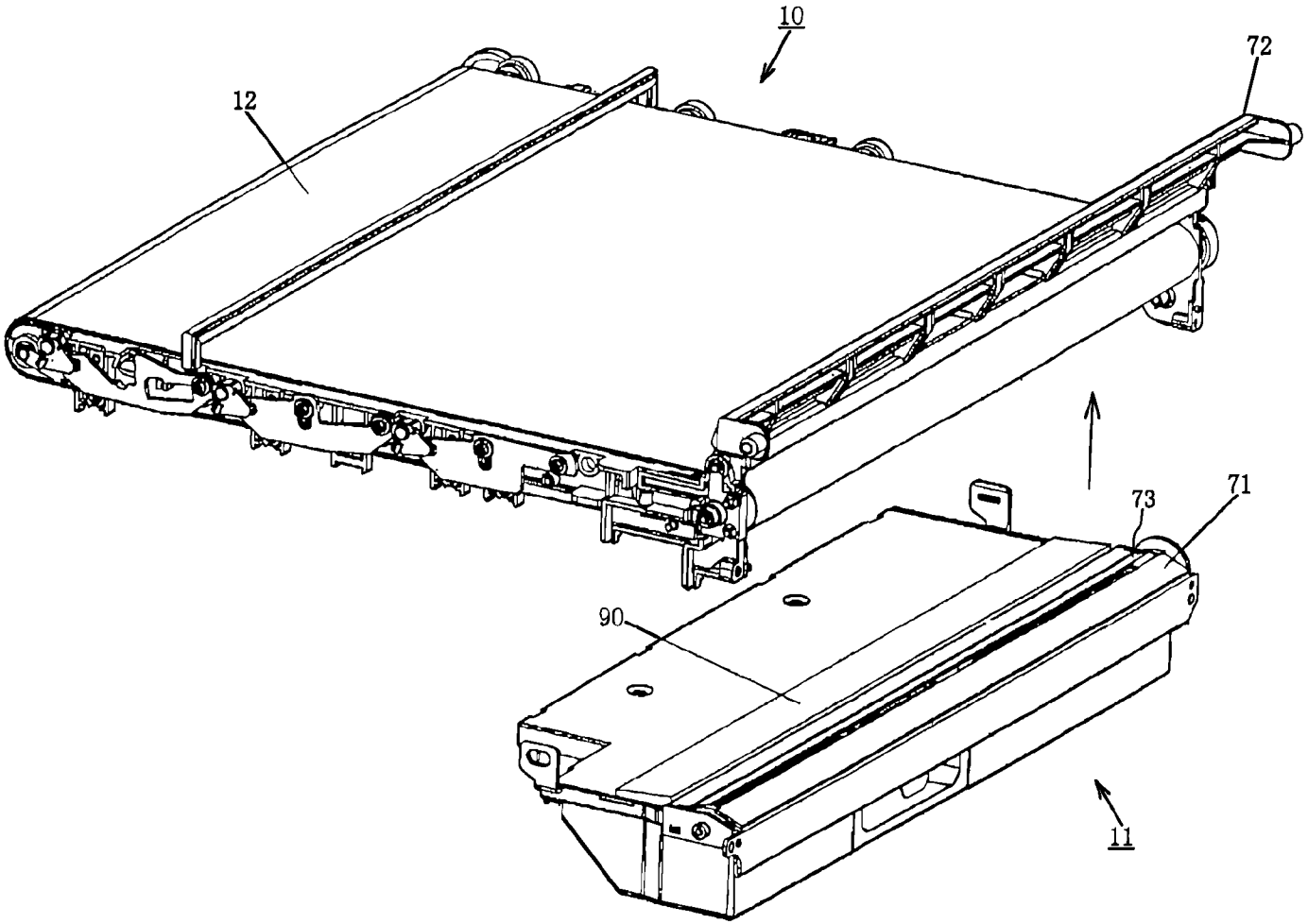
FIG. 5 is a perspective view showing the transportation belt unit and a waste toner box portion detached from the transportation belt unit according to the first embodiment of the present invention.
Figure 6:
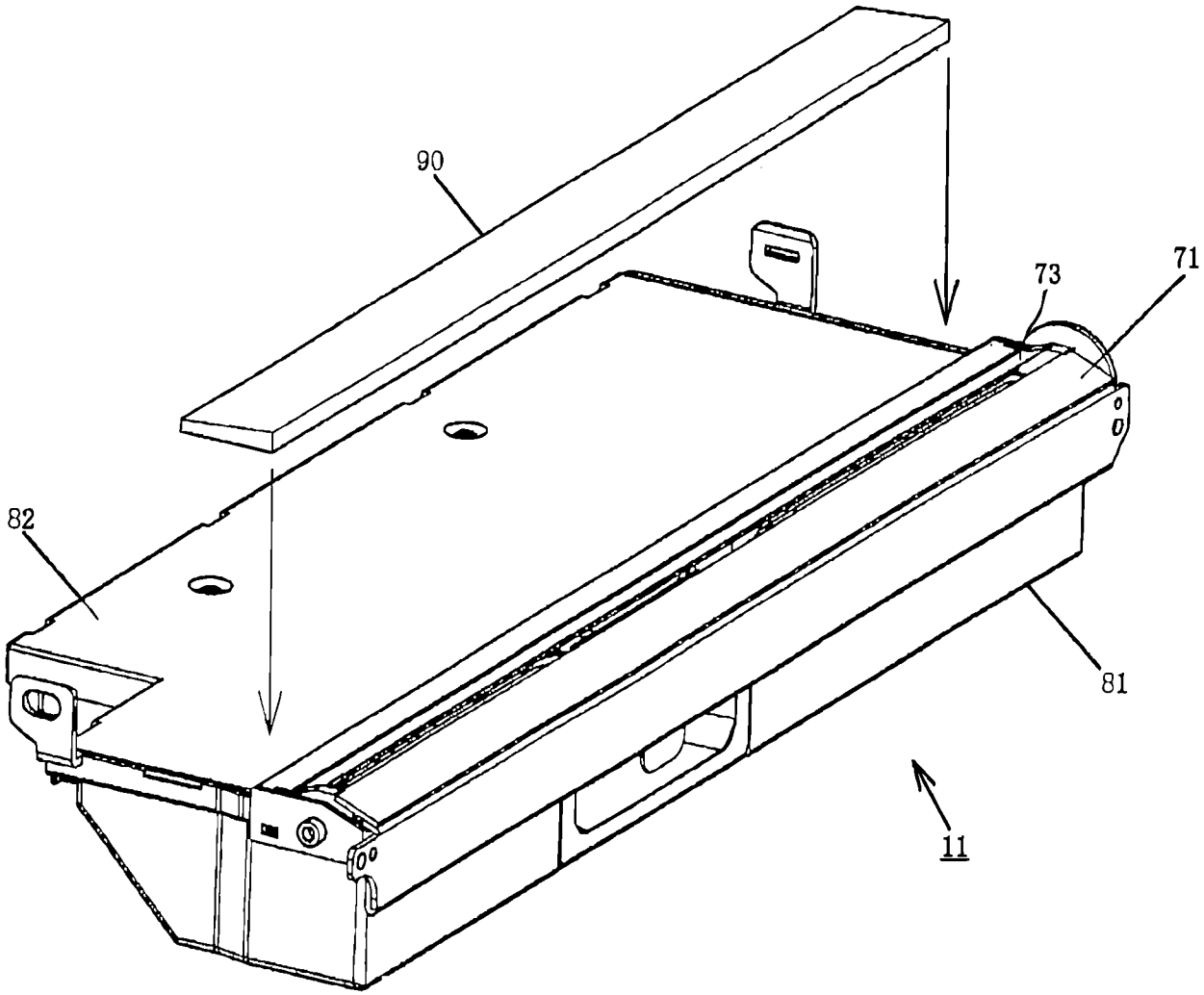
FIG. 6 is a perspective view showing the waste toner box portion and a toner retaining member detached from the waste toner box portion according to the first embodiment of the present invention.
Figure 7:
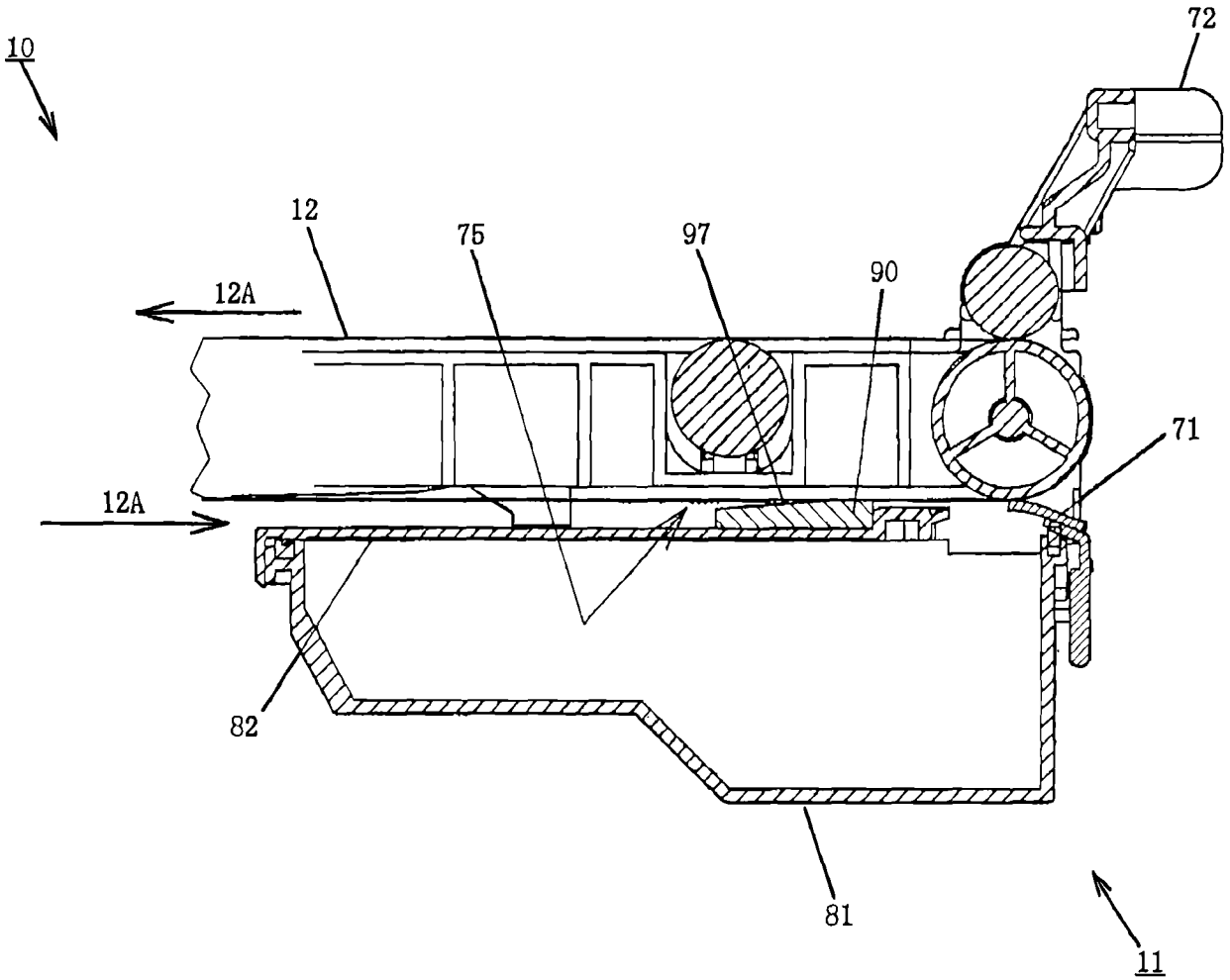
FIG. 7 is a sectional view of the transportation belt unit of the image forming apparatus taken along a line 7-7 in FIG. 4 according to the first embodiment of the present invention.

A configuration of the transportation belt unit 10 will be explained in more detail next. FIG. 4 is a perspective view showing the transportation belt unit 10 of the image forming apparatus 1 according to the first embodiment of the present invention. FIG. 5 is a perspective view showing the transportation belt unit 10 and the waste toner box portion 11 detached from the transportation belt unit 10 according to the first embodiment of the present invention. FIG. 6 is a perspective view showing the waste toner box portion 11 and a toner retaining member 90 detached from the waste toner box portion according to the first embodiment of the present invention. FIG. 7 is a sectional view of the transportation belt unit 10 of the image forming apparatus 1 taken along a line 7-7 in FIG. 4 according to the first embodiment of the present invention.

As shown in FIG. 4, the transportation belt unit 10 includes the transportation belt 12, a frame 72, and the waste toner box portion 11. The waste toner box portion 11 is attached to a part of the frame 72. As shown in FIG. 6, the waste toner box portion 11 includes a waste toner case 81 for retaining waste toner and a waste toner case cover 82.

In the embodiment, the transportation belt unit 10 further includes a blade member or a cleaning blade 71 for scraping and removing remaining toner 75 remaining on the transportation belt 12. The cleaning blade 71 is fixed to the waste toner box portion 11, so that a distal end portion of the cleaning blade 71 abuts against a lower surface of the transportation belt 12. A film 73 is provided for preventing the remaining toner 75 to be scraped from scattering around. After the cleaning blade 71 removes the remaining toner 75, the remaining toner 75 is retained in the waste toner case 81 as waste toner.

In the embodiment, the transportation belt unit 10 further includes the toner retaining member 90 formed of, for example, a urethane foam (sponge) having good flexibility and slidability. The toner retaining member 90 is provided for temporarily retaining the remaining toner 75 on the transportation belt 12. The toner retaining member 90 is disposed on an upstream side of the cleaning blade 71 in a direction that the transportation belt 12 moves, or a transportation direction. Further, the toner retaining member 90 is disposed on an upper surface of the waste toner case cover 82 to abut against a lower surface of the transportation belt 12. The toner retaining member 90 includes a toner retaining surface 97 where toner is retained.

In the embodiment, the cleaning blade 71 abuts against the surface of the transportation belt in a counter direction for the direction that the transportation belt 12 moves, so that the cleaning blade 71 scrapes off the remaining toner 75 attached to the surface of the transportation belt 12. After the cleaning blade 71 scrapes off the remaining toner 75, the remaining toner 75 is collected in the waste toner box portion 11, and then discarded.

When the cleaning blade 71 scrapes and removes the remaining toner 75, a part of the remaining toner 75 sticks to an abutting surface between the transportation belt 12 and the cleaning blade 71, so that toner reduces friction between the transportation belt 12 and the cleaning blade 71. For this reason, it is preferable to stick toner to the cleaning blade 71. In the embodiment, according to the count value of the page number counted with the page counter 44*a*, the coat toner image 103 is formed on the transportation belt 12 when an image forming operation is not performed.

Figure 8:
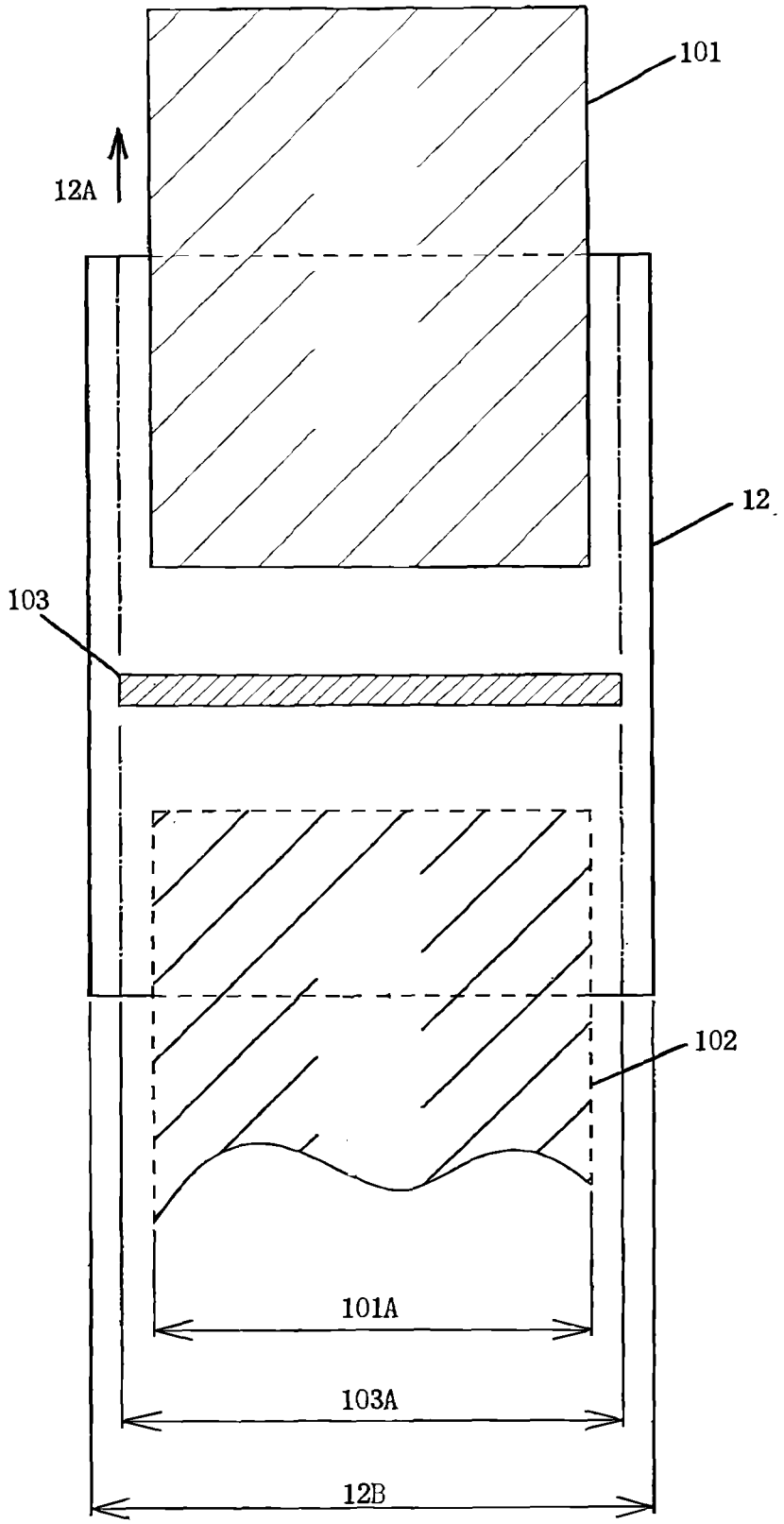
FIG. 8 is a schematic view showing a transportation belt having a coat toner image formed on a surface thereof according to the first embodiment of the present invention.

An operation of forming the coat toner image 103 will be explained next. FIG. 8 is a schematic view showing the transportation belt 102 having the coat toner image 103 formed on a surface thereof according to the first embodiment of the present invention.

As shown in FIG. 8, the coat toner image 103 is formed in a specific area on the transportation belt 12 in a width direction thereof. Note that the coat toner image 103 may be formed in any area on the transportation belt 12 in a transportation direction thereof. In the embodiment, it is not necessary to form the coat toner image 103 in an area between sheets. Sheets with a maximum width are placed in areas 101 and 102.

After the toner images as recording images are formed on a surface of the sheet, the transportation belt 12 transports the sheet in the transportation direction indicated by an arrow 12A. During no image forming operation, the coat toner image 103 with a width 103A is formed on the transportation belt 12. In this case, the coat toner image 103 has the width 103A smaller than a width 12B of the transportation belt 12 and larger than a width 101A of the sheet. The width 101A is the maximum width that the image forming apparatus 1 can handle.

In the embodiment, the toner retaining member 90 preferably has a width equal to or larger than the width 103A of the coat toner image 103. Note that the coat toner image 103 has an arbitrary length in the transportation direction. A length of the coat toner image 103 in the transportation direction may be determined depending on a frictional load between the transportation belt 12 and the cleaning blade 71, a transportation speed, and the likes according to an image forming apparatus.

In the embodiment, any one of the image forming units 26BK, 26Y, 26M, and 26C may form the coat toner image 103. It is preferably to form the coat toner image 103 with the image forming unit 26Y for forming an image in yellow. Among toner in four colors, toner in yellow provides most preferably sliding property, so that it is possible to effectively reduce a frictional load between the surface of the transportation belt 12 and the cleaning blade 71.

In order to prevent the cleaning blade 71 from being curled up, it is preferred to form the coat toner image 103 after the image forming operation is performed on a certain number of sheets. Further, the coat toner image 103 is not formed between sheets transported during conducting a print job, and is formed when a print job is not conducted according to an accumulated print number, that is, inbetween print jobs.

An operation of the image forming apparatus 1 will be explained next. First, an operation of retaining the remaining toner 75 in the toner retaining member 90 will be explained. When the image forming apparatus 1 is turned on and the printing operation starts after an initial process, the transportation belt 12 moves in the sheet transportation direction indicated as the arrow direction 12A in FIG. 8.

As described above, the coat toner image 103 is formed on the surface of the transportation belt 12 as the remaining toner 75. Further, the toner retaining member 90 is disposed under the lower surface of the transportation belt 12 to abut against the transportation belt 12 for temporarily retaining the remaining toner 75 on the transportation belt 12. Accordingly, when the remaining toner 75 on the transportation belt 12 passes through the toner retaining member 90, the remaining toner 75 is temporarily retained on a toner retaining surface 97 of the toner retaining member 90.

In the printing operation, when the transportation belt 12 keeps moving in the sheet transportation direction, the remaining toner 75 retained on the toner retaining surface 97 of the toner retaining member 90 slips away from the toner retaining member 90 and sticks to the surface of the transportation belt 12. Accordingly, the remaining toner 75 moves with the surface of the transportation belt 12 toward a downstream side in the sheet transportation direction. As a result, the remaining toner 75 on the surface of the transportation belt 12 is repeatedly retained and supplied back to the surface of the transportation belt 12 at the toner retaining surface 97 of the toner retaining member 90.

When the remaining toner 75 on the transportation belt 12 passes through the toner retaining member 90, a part of the remaining toner 75 is not retained in the toner retaining member 90, and moves with the surface of the transportation belt 12 in a moving direction of the transportation belt 12, i.e., toward the downstream side in the sheet transportation direction. In the embodiment, the cleaning blade 71 is disposed on the downstream side in the sheet transportation direction. Accordingly, the cleaning blade 71 scrapes off the remaining toner 75 passing through the toner retaining member 90. In this case, when the cleaning blade 71 scrapes off the remaining toner 75, the remaining toner 75 drops into the waste toner case 81 to be retained as waste toner. A stirring bar is disposed in the waste toner box portion 11 for transporting waste toner to a back portion of the waste toner case 81.

When the cleaning blade 71 scrapes off the remaining toner 75 on the transportation belt 12, the remaining toner 75 adheres to an abutting surface between the transportation belt 12 and the cleaning blade 71. In this case, the remaining toner 75 adhering to the abutting surface reduces a frictional load between the surface of the transportation belt 12 and the remaining toner 75, thereby preventing the cleaning blade 71 from being curled up. Accordingly, as long as the remaining toner 75 is consistently supplied from the toner retaining surface 97 of the toner retaining member 90 to the surface of the transportation belt 12, it is possible to obtain a constant frictional load between the surface of the transportation belt 12 and the cleaning blade 71, thereby making it possible to prevent the cleaning blade 71 from being curled up.

When the printing operation is repeated, the transportation belt 12 tends to ware, thereby lowering the function of sucking a sheet and transferring toner. Accordingly, it is preferable to set a life of the toner retaining member 90 as the same as that of the transportation belt 12, and exchange the toner retaining member 90 as the transportation belt unit 10 regularly.

Figure 9:
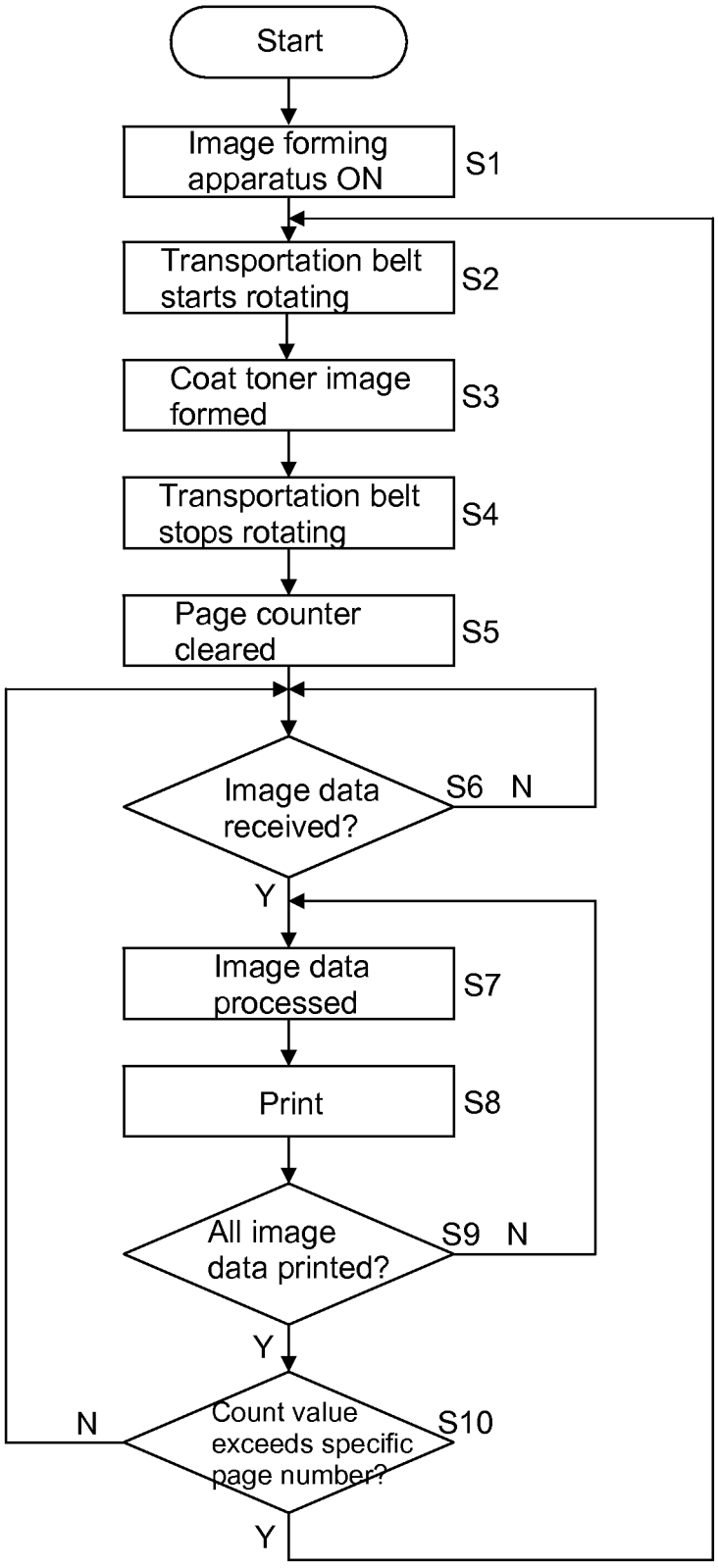
FIG. 9 is a flowchart showing an operation of the image forming apparatus according to the first embodiment of the present invention.

An operation of forming the coat toner image 103 will be explained next. FIG. 9 is a flowchart showing the operation of the image forming apparatus according to the first embodiment of the present invention.

In the first step, the image forming apparatus 1 is turned on and the image forming apparatus 1 starts the initial operation, so that the transportation belt 12 starts rotating. In the next step, the control unit 44 forms the coat toner image 103 using print data stored in an internal memory in advance for forming the coat toner image 103, and the transportation belt 12 stops rotating. It is preferred that the transportation belt 12 stops rotating after rotating until the coat toner image 103 formed on the surface of the transportation belt 12 passes through the toner retaining member 90. With this operation, it is possible to securely adhere the coat toner image 103 formed on the transportation belt 12 to the toner retaining member 90. Then, the control unit 44 clears the page counter 44*a*.

In the next step, the control unit 44 determines whether the command and the image data are received from the host device through the interface 41. When the command and the image data are received, the command image processing unit 42 processes and converts the image data to printable data per page according to the command. At this time, the control unit 44 increases the page counter 44*a* by one after the image data are processed for one page. When the command and the image data are not received, the control unit 44 repeatedly determines whether the command and the image data are received.

In the next step, the control unit 44 performs the printing operation. Then, the control unit 44 determines whether the print job is completed, that is, all of the image data are printed. When the print job is not completed, the image processing and the printing operation are repeated. When the print job is completed, the control unit 44 compares a specific page number stored in an internal memory in advance, for example, 100, with the count value of the page counter 44*a* upon completing the print job.

In the next step, when the count value exceeds the specific page number, the coat toner image 103 is formed on the transportation belt 12. At this time, when next image data are received, the next image data are temporarily stored in a data storage unit (not shown). After the coat toner image 103 is formed, the next image data are retrieved from the data storage unit for the image processing. When the count value is below the specific page number, the next image data are received.

The flowchart shown in FIG. 9 will be explained next. In step S1, the image forming apparatus 1 is turned on. In step S2, the transportation belt 12 starts rotating. In step S3, the coat toner image 103 is formed. In step S4, the transportation belt 12 stops rotating.

In step S5, the page counter 44*a* is cleared. In step S6, it is determined whether the command and the image data are received. When the command and the image data are received, the process proceeds to step S7. When the command and the image data are not received, it is repeatedly determined whether the command and the image data are received.

In step S7, the image data are processed per page and converted to the printable data. In step S8, the printing operation is performed. In step S9, it is determined whether all of the image data are printed. When all of the image data are printed, the process proceeds to step S10. When all of the image data are not printed, the process returns to step S7. In step S10, it is determined whether the count value exceeds the specific page number. When the count value exceeds the specific page number, the process returns to step S3. When the count value does not exceed the specific page number, the process returns to step S6.

As described above, in the embodiment, the transportation belt unit 10 is provided with the cleaning blade 71 for scraping off the remaining toner 75 adhering to the surface of the transportation belt 12. Further, the transportation belt unit 10 is provided with the toner retaining member 90. Accordingly, it is possible to temporarily retain the remaining toner 75 adhering to the surface of the transportation belt 12 on the toner retaining surface 97 of the toner retaining member 90, and to supply the remaining toner 75 back to the surface of the transportation belt 12. That is, it is possible to repeatedly retain the remaining toner 75 on the toner retaining surface 97 of the toner retaining member 90 and supply to the surface of the transportation belt 12. Accordingly, it is possible to continuously supply the remaining toner 75 to the abutting surface between the surface of the transportation belt 12 and the cleaning blade 71. As a result, it is possible to stabilize the frictional load between the surface of the transportation belt 12 and the cleaning blade 71, thereby preventing the cleaning blade 71 from being curled up.

In the embodiment, the toner retaining member 90 is attached and fixed to the waste toner case 81. Alternatively, the toner retaining member 90 may be arranged to be detachable from the waste toner case 81.

Second Embodiment

A second embodiment of the present invention will be explained next. Components in the second embodiment similar to those in the first embodiment are designated with the same reference numerals, and explanations thereof are omitted. Further, explanations of effects and operations in the second embodiment similar to those in the first embodiment are omitted as well.

Figure 10:
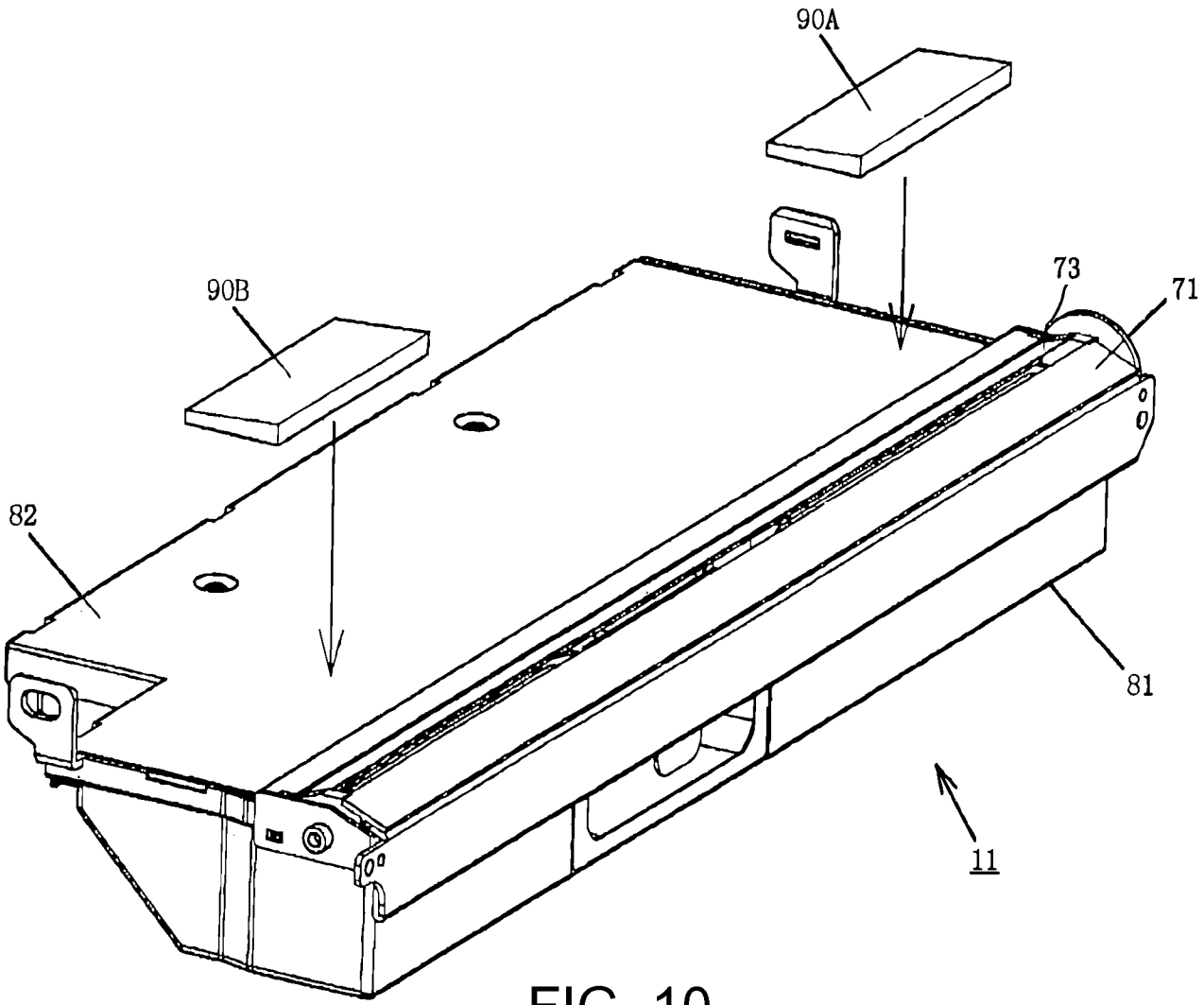
FIG. 10 is a perspective view showing a waste toner box portion of an image forming apparatus and a toner retaining member detached from the waste toner box portion according to a second embodiment of the present invention.

FIG. 10 is a perspective view showing the waste toner box portion 11 and the toner retaining members 90A and 90B detached from the waste toner box portion 11 according to the second embodiment of the present invention.

In the first embodiment, the toner retaining member 90 is integrally formed to extend over a whole portion of the transportation belt 12 in the width direction thereof. In this case, the toner retaining surface 97 of the toner retaining member 90 abuts against the surface of the transportation belt 12, thereby causing a relatively large load on the transportation belt 12.

In the second embodiment, as shown in FIG. 10, the toner retaining member includes two toner retaining members 90A and 90B. The toner retaining members 90A and 90B are disposed on an upper surface of the waste toner case cover 82 and abut against the lower surface of the transportation belt 12. Other configurations in the second embodiment are similar to those in the first embodiment, and explanations thereof are omitted.

Figure 11:
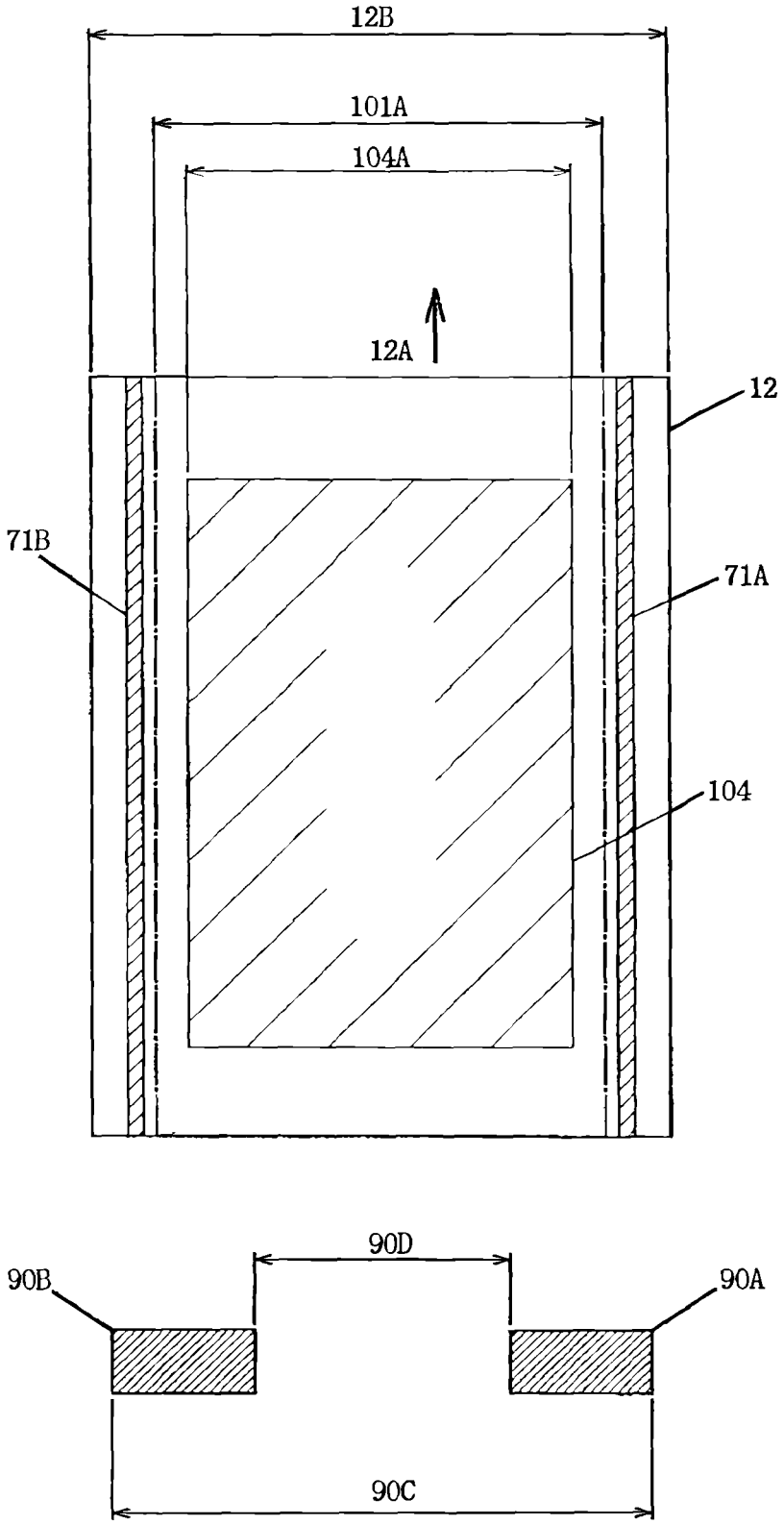
FIG. 11 is a schematic view showing the toner retaining member according to the second embodiment of the present invention.

The toner retaining members 90A and 90B will be explained in more detail next. FIG. 11 is a schematic view showing the toner retaining members 90A and 90B according to the second embodiment of the present invention. As shown in FIG. 11, three widths are imaginary defined on the transportation belt 12: a width of sheets most frequently used; a width of a test pattern for color shift correction; and a width of an area where the toner retaining members 90A and 90B are disposed. Note that an image on a sheet and the test pattern on the transportation belt 12 are not formed simultaneously.

As shown in FIG. 11, sheets most frequently used such as A4 size sheets are placed on an area having a width 104. A toner image is formed on the sheet as a recording image, and the transportation belt 12 transports the sheet in the sheet transportation direction indicated with the arrow direction 12A.

In the embodiment, color shift correction image areas 71A and 71B for color shift correction are defined on the transportation belt 12 inside a width 12B of the transportation belt 12 and outside a width 101A of a sheet having a largest size that the image forming apparatus 1 can handle.

In the embodiment, the toner retaining members 90A and 90B are disposed as shown in FIG. 11. More specifically, a width 90C between outer edges of the toner retaining members 90A and 90B is defined on the transportation belt 12 such that the outer edges of the toner retaining members 90A and 90B are situated outside the color shift correction image areas 71A and 71B. Further, a width 90D between inner edges of the toner retaining members 90A and 90B is defined on the transportation belt 12 inside the width 104 of the sheets most frequently used. Accordingly, the toner retaining members 90A and 90B are situated over the color shift correction image areas 71A and 71B and side edges of the sheets most frequently used.

An operation of color shift correction will be explained next. In the first step, the control unit 44 starts the LED control unit 45 and the high-voltage control unit 46. Accordingly, the image forming units 26BK, 26Y, 26M, and 26C form toner images for color shift correction on the surfaces of the photosensitive drums 61, and the transfer rollers 27BK, 27Y, 27M, and 27C transfer the test patterns for color shift correction on the transportation belt 12 at side edges portions thereof in the width direction thereof.

In the next step, the image detection sensor 33 detects the test patterns formed on the transportation belt 12. Note that the test patterns of black toner, yellow toner, magenta toner, and cyan toner have different light reflection indexes, and the surface of the transportation belt 12 has also a different light reflection index. Accordingly, the image detection sensor 33 outputs voltage signals having wave shapes according to positions and colors of the test patterns for color shift correction formed on the transportation belt 12.

In the next step, the control unit 44 receives the voltage signals sent from the image detection sensor 33, and detects a shift amount of the test patterns formed on the transportation belt 12 according to the voltage signals thus received. Then, the control unit 44 adjusts a timing of forming the toner images in the image forming units 26BK, 26Y, 26M, and 26C according to the shift amount thus detected.

In adjusting the timing, each of the LED heads 28BK, 28Y, 28M, and 28C of the image forming units 26BK, 26Y, 26M, and 26C forms the static latent image at an adjusted timing. That is, the control unit 44 adjusts a scanning position and a scanning start timing of each of the LED heads 28BK, 28Y, 28M, and 28C, thereby correcting a shift of the test pattern in each color in a main scanning direction (width direction of the transportation belt 12) and a sub scanning direction (moving direction of the transportation belt 12).

An operation of the image forming apparatus 1 will be explained next. First, an operation of retaining the remaining toner 75 in the toner retaining members 90A and 90B will be explained.

In the embodiment, it is arranged such that the remaining toner 75 used for color shift correction is actively collected and supplied. To this end, the toner retaining members 90A and 90B abut against the lower surface of the transportation belt 12 for temporarily retaining the remaining toner 75 adhering to the transportation belt 12. Further, the toner retaining members 90A and 90B are arranged at positions covering the color shift correction image areas 71A and 71B and the side edges of the sheets most frequently used. Accordingly, when the remaining toner 75 adhering to the transportation belt 12 passes through the toner retaining members 90A and 90B, the remaining toner 75 is temporarily retained on the toner retaining surfaces 97 of the toner retaining members 90A and 90B.

When the transportation belt 12 keeps moving in the sheet transportation direction during the printing operation, the remaining toner 75 temporarily retained on the toner retaining surfaces 97 of the toner retaining members 90A and 90B slips away from the toner retaining members 90A and 90B, and adheres to the surface of the transportation belt 12 one more time, thereby moving with the surface of the transportation belt 12 toward the downstream side in the sheet transportation direction.

The remaining toner 75 retained on the toner retaining surfaces 97 is also retained most at positions corresponding to the color shift correction image areas 71A and 71B. With the transportation of the transportation belt 12, the remaining toner 75 spreads a whole area of the toner retaining surfaces 97. Accordingly, it is possible to supply the remaining toner 75 to the transportation belt 12 over a range of a contact width with respect to the toner retaining members 90A and 90B.

Accordingly, the remaining toner 75 on the surface of the transportation belt 12 is repeatedly collected and supplied back to the surface of the transportation belt 12 at the toner retaining surfaces 97 of the toner retaining members 90A and 90B.

When the remaining toner 75 on the transportation belt 12 passes through the toner retaining members 90A and 90B, a part of the remaining toner 75 is not retained in the toner retaining members 90A and 90B, and moves with the surface of the transportation belt 12 in the moving direction of the transportation belt 12, i.e., toward the downstream side in the sheet transportation direction. In the embodiment, the cleaning blade 71 is disposed on the downstream side in the sheet transportation direction. Accordingly, the cleaning blade 71 scrapes off the remaining toner 75 passing through the toner retaining members 90A and 90B. In this case, when the cleaning blade 71 scrapes off the remaining toner 75, the remaining toner 75 drops into the waste toner case 81 to be retained as waste toner.

When the cleaning blade 71 scrapes off the remaining toner 75 on the transportation belt 12, the remaining toner 75 adheres to an abutting surface between the transportation belt 12 and the cleaning blade 71. In this case, the remaining toner 75 adhering to the abutting surface reduces a frictional load between the surface of the transportation belt 12 and the remaining toner 75, thereby preventing the cleaning blade 71 from being curled up.

In the embodiment, the toner retaining members 90A and 90B are arranged at the positions covering the color shift correction image areas 71A and 71B in the width direction of the sheet. Accordingly, it is possible to actively collect and supply the remaining toner 75 used for color shift correction. In general, color shift correction is regularly performed when the image forming apparatus 1 is turned on, and a top cover is closed, or according to the count value of printed sheets. Accordingly, it is possible to regularly supply the remaining toner 75 to the toner retaining members 90A and 90B.

Further, in the embodiment, the toner retaining members 90A and 90B are situated over the side edges of the sheets most frequently used in the width direction thereof. Accordingly, when sheets having a same width are printed continuously, it is possible to effectively prevent the cleaning blade 71 from being curled up.

As described above, it is possible to continuously supply the remaining toner 75 on the surface of the transportation belt 12, thereby stabilizing the frictional load between the cleaning blade 71 and the surface of the transportation belt 12, and preventing the cleaning blade 71 from being curled up. Further, the toner retaining members 90A and 90B have a necessity minimum width, thereby reducing a load on the transportation belt 12.

Figure 12:
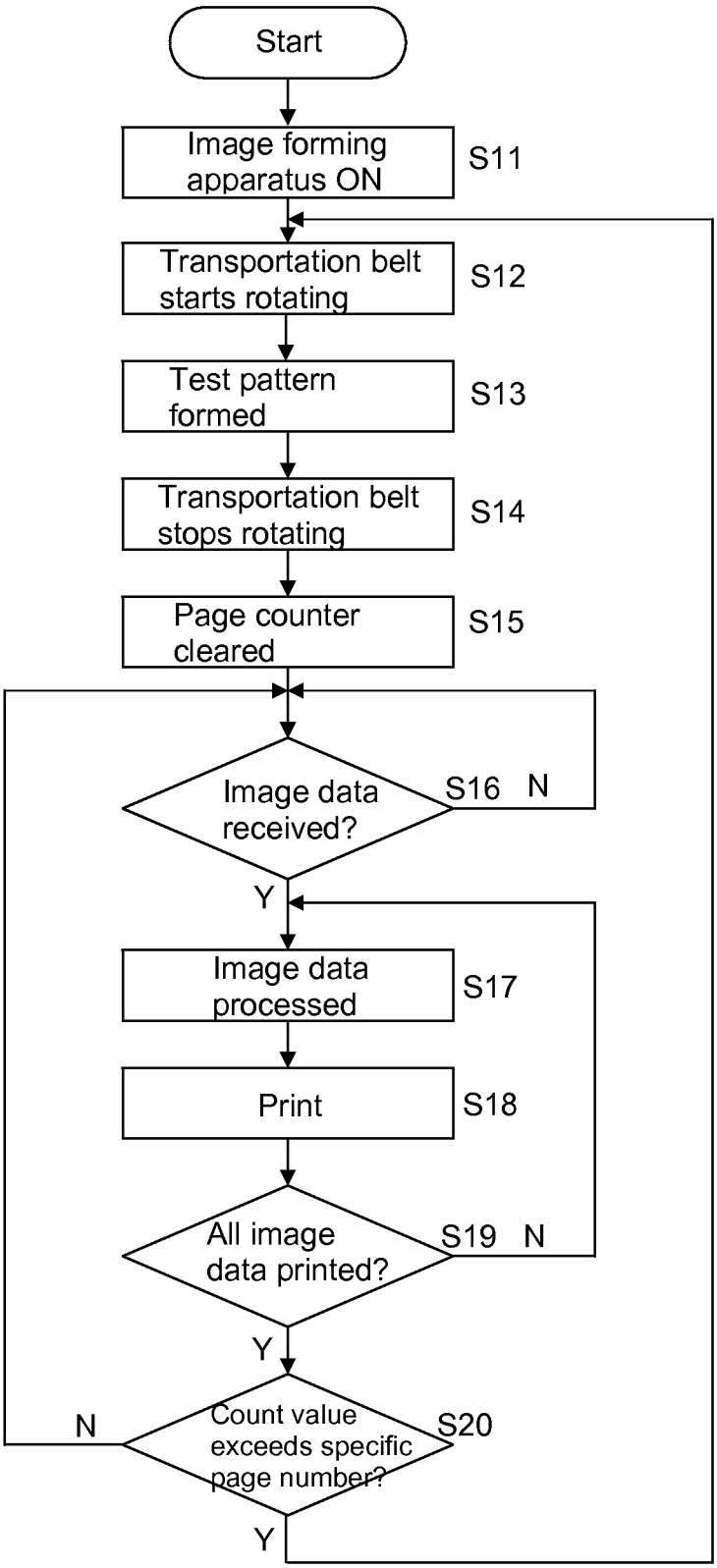
FIG. 12 is a flowchart showing an operation of the image forming apparatus according to the second embodiment of the present invention.

An operation of forming the test pattern for color shift correction will be explained next. FIG. 12 is a flowchart showing an operation of the image forming apparatus 1 according to the second embodiment of the present invention.

In the first step, the image forming apparatus 1 is turned on and the image forming apparatus 1 starts the initial operation, so that the transportation belt 12 starts rotating. In the next step, the control unit 44 forms the test patterns on the transportation belt 12 using print data of the test patterns for color shift correction stored in an internal memory in advance. Accordingly, color shift correction is performed, and the transportation belt 12 stops rotating. Then, the page counter 44*a* is cleared.

In the next step, the control unit 44 determines whether the command and the image data are received from the host device through the interface 41. When the command and the image data are received, the command image processing unit 42 processes and converts the image data to printable data per page according to the command. At this time, the control unit 44 increases the page counter 44*a* by one after the image data are processed for one page. When the command and the image data are not received, the control unit 44 repeatedly determines whether the command and the image data are received.

In the next step, the control unit 44 performs the printing operation. Then, the control unit 44 determines whether the print job is completed, that is, all of the image data are printed. When the print job is not completed, the image processing and the printing operation are repeated. When the print job is completed, the control unit 44 compares a specific page number stored in an internal memory in advance, for example, 100, with the count value of the page counter 44*a* upon completing the print job.

In the next step, when the count value exceeds the specific page number, the test patterns for color shift correction are formed on the transportation belt 12. At this time, when next image data are received, the next image data are temporarily stored in a data storage unit (not shown). After color shift correction is performed, the next image data are retrieved from the data storage unit for the image processing. When the count value is below the specific page number, the next image data are received.

The flowchart shown in FIG. 12 will be explained next. In step S11, the image forming apparatus 1 is turned on. In step S12, the transportation belt 12 starts rotating. In step S13, the test patterns are formed, and color shift correction is performed. In step S14, the transportation belt 12 stops rotating.

In step S15, the page counter 44*a* is cleared. In step S16, it is determined whether the command and the image data are received. When the command and the image data are received, the process proceeds to step S17. When the command and the image data are not received, it is repeatedly determined whether the command and the image data are received.

In step S17, the image data are processed per page and converted to the printable data. In step S18, the printing operation is performed. In step S19, it is determined whether all of the image data are printed. When all of the image data are printed, the process proceeds to step S20. When all of the image data are not printed, the process returns to step S17. In step S20, it is determined whether the count value exceeds the specific page number. When the count value exceeds the specific page number, the process returns to step S13. When the count value does not exceed the specific page number, the process returns to step S16.

As described above, in the embodiment, the toner retaining members 90A and 90B are arranged at the positions covering the color shift correction image areas 71A and 71B and the side edges of the sheets most frequently used. Accordingly, it is possible to effectively collect and supply the remaining toner 75 on the surface of the transportation belt 12, thereby stabilizing the frictional load between the cleaning blade 71 and the surface of the transportation belt 12. As a result, when the sheets most frequently used (having a same size) are continuously printed, it is possible to prevent the cleaning blade 71 from being curled up.

Further, the toner retaining members 90A and 90B have a necessity minimum width, thereby reducing a load on the transportation belt 12, and preventing performance of the transportation belt 12 from lowering. Note that the second embodiment provided effects the same as those in the first embodiment as well.

Third Embodiment

A third embodiment of the present invention will be explained next. Components in the third embodiment similar to those in the first and second embodiments are designated with the same reference numerals, and explanations thereof are omitted. Further, explanations of effects and operations in the third embodiment similar to those in the first and second embodiments are omitted as well.

Figure 13:
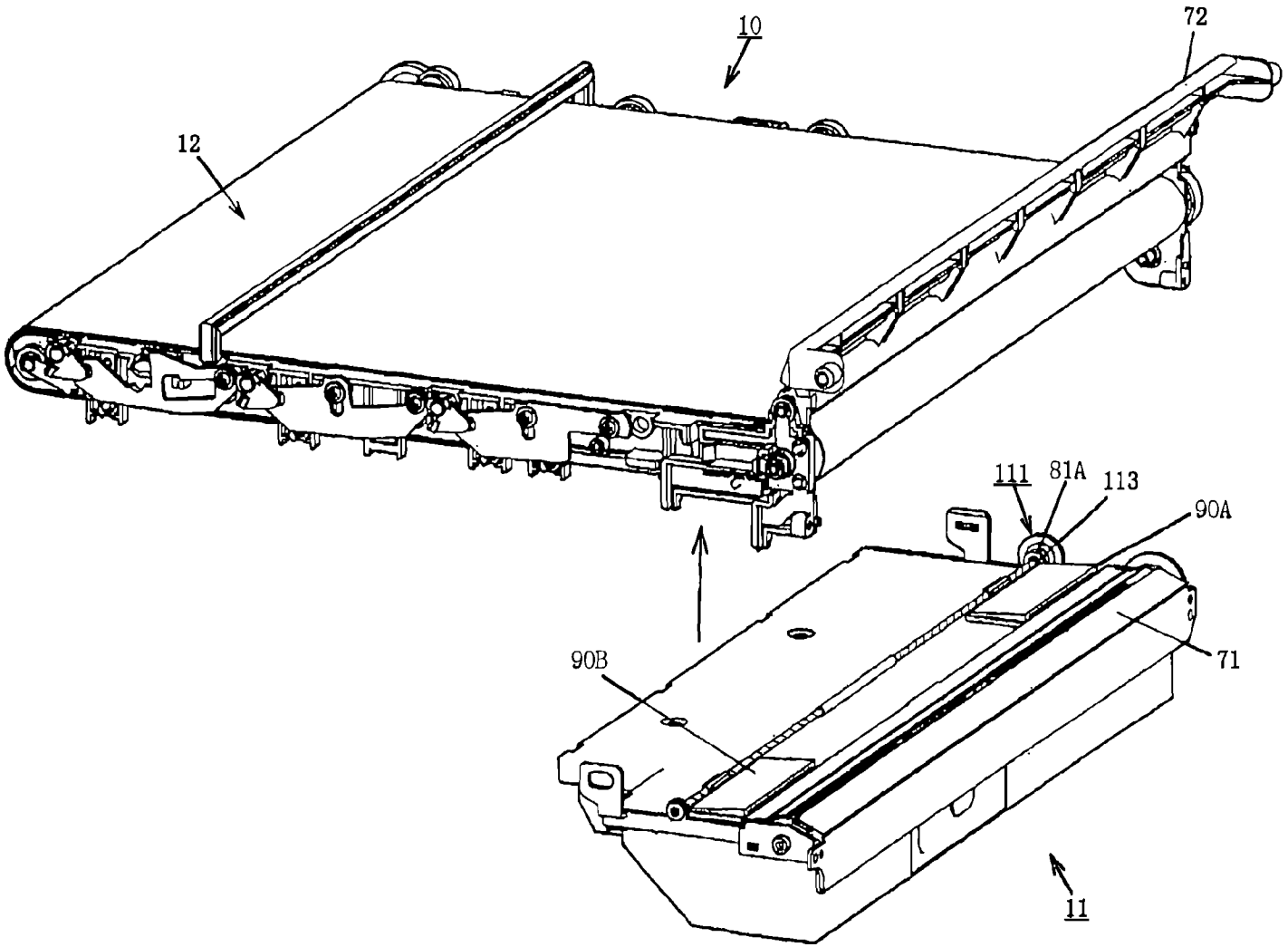
FIG. 13 is a perspective view showing a transportation belt unit of an image forming apparatus and a waste toner box portion detached from the transportation belt unit according to a third embodiment of the present invention.
Figure 14:
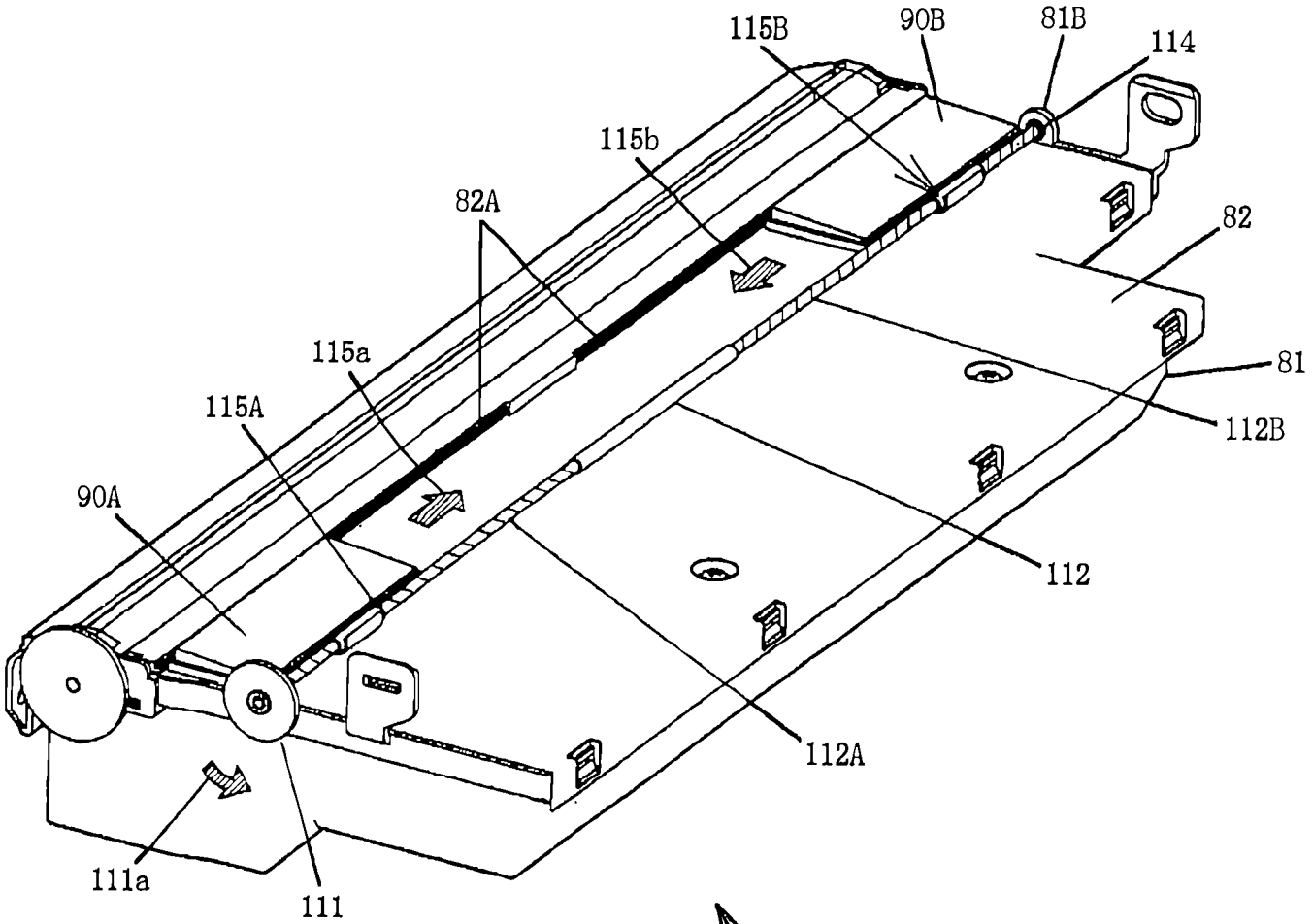
FIG. 14 is a perspective view showing a waste toner box portion of the image forming apparatus and a toner retaining member attached to the waste toner box portion according to the third embodiment of the present invention.
Figure 15:
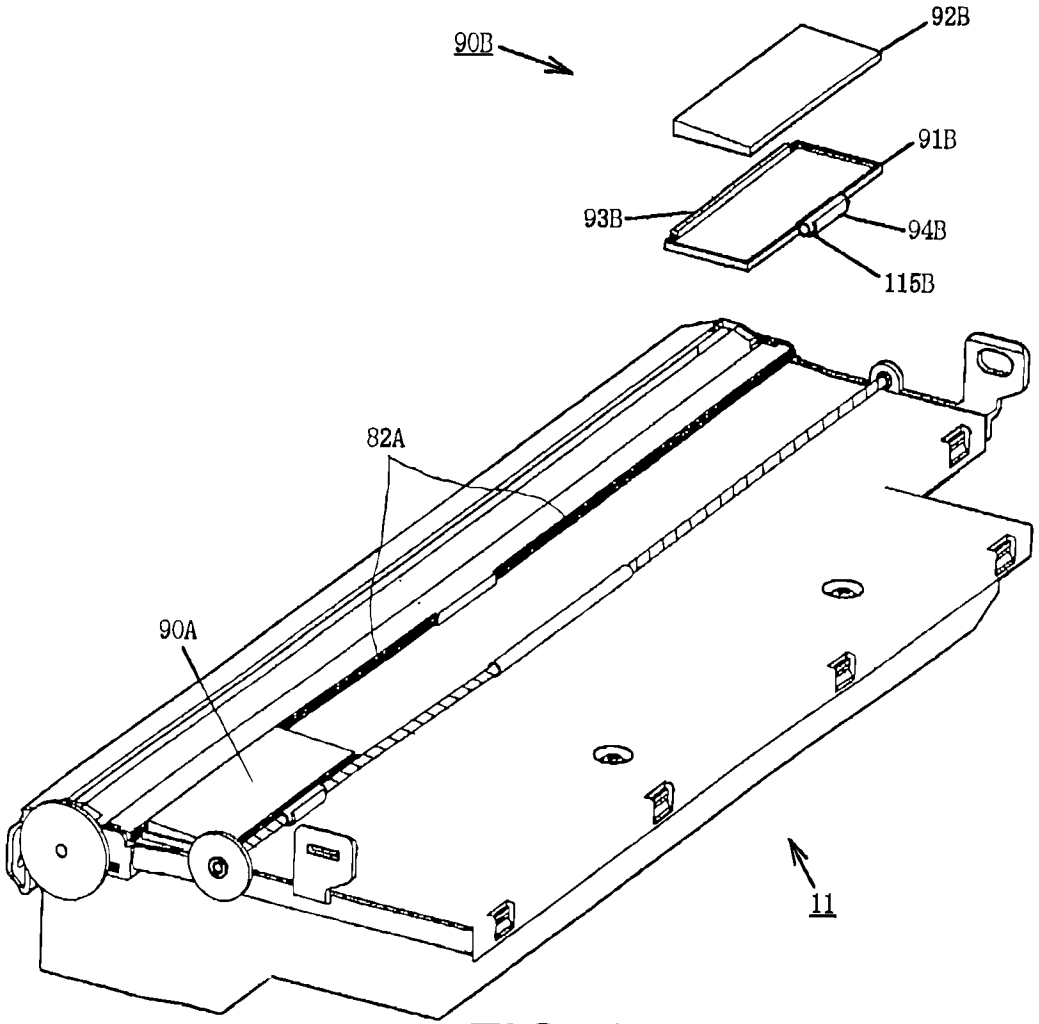
FIG. 15 is a perspective view showing the waste toner box portion and the toner retaining member detached from the waste toner box portion according to the third embodiment of the present invention.
Figure 16:
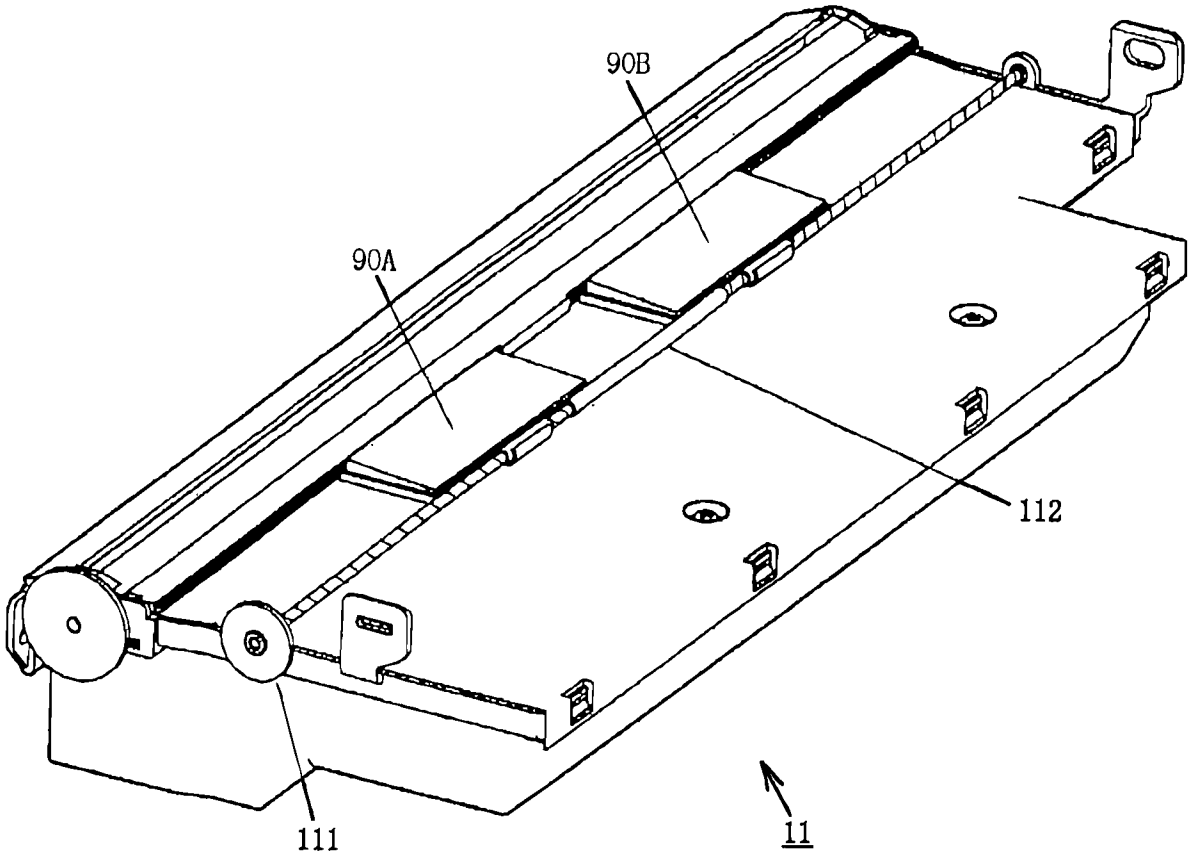
FIG. 16 is a perspective view showing the waste toner box portion and the toner retaining member attached to the waste toner box portion according to the third embodiment of the present invention.

FIG. 13 is a perspective view showing the waste toner box portion 11 detached from the transportation belt unit 10 according to the third embodiment of the present invention. FIG. 14 is a perspective view showing the toner retaining members 90A and 90B attached to the waste toner box portion 11 according to the third embodiment of the present invention. FIG. 15 is a perspective view showing the toner retaining members 90A and 90B detached from the waste toner box portion 11 according to the third embodiment of the present invention. FIG. 16 is a perspective view showing the toner retaining members 90A and 90B arranged according to a width of a sheet having a narrow width according to the third embodiment of the present invention.

In the second embodiment, the toner retaining members 90A and 90B are arranged over the side edges of the sheets most frequently used. In an actual case, the sheets most frequently used depend on a user of the image forming apparatus 1. Accordingly, in the third embodiment, it is possible to adjust positions of the toner retaining members 90A and 90B along the width direction of the sheet.

As shown in FIG. 15, the toner retaining member 90B includes a toner retaining pad 92B and a toner retaining pad holder 91B. The toner retaining pad 92B includes a slider portion 93B and a shaft clamp holding portion 94B integrated together. A guide portion 82A is formed as a part of the waste toner case cover 82 for holding the slider portion 93B. The shaft clamp holding portion 94B holds a shaft clamp 115B.

In the embodiment, the toner retaining member 90A includes components (including a shaft clamp 115A) similar to those of the toner retaining member 90B. A drive gear 111 is fixed to an end portion of a drive shaft 112 for moving the toner retaining members 90A and 90B. The drive shaft 112 is formed of a shaft having spiral grooves 112A and 112B. Shaft bearing portions 81A and 81B are formed as a part of the waste toner case cover 82 for holding the drive shaft 112 through bearing collar 113 and 114.

In the embodiment, the shaft clamp 115A and 115B of the toner retaining members 90A and 90B engage the spiral grooves 112A and 112B of the drive shaft 112, respectively. The spiral grooves 112A and 112B extend in different directions with each other. Accordingly, when the drive gear 111 rotates in an arrow direction 111*a*, the toner retaining member 90A moves in an arrow direction 115*a* together with the shaft clamp 115A. At the same time, the toner retaining member 90B moves in an arrow direction 115*b* together with the shaft clamp 115B.

An operation of the image forming apparatus 1 will be explained next. First, an operation of retaining the remaining toner 75 in the toner retaining members 90A and 90B will be explained.

When the remaining toner 75 adhering to the transportation belt 12 passes through the toner retaining members 90A and 90B, the remaining toner 75 is temporarily retained on the toner retaining surfaces 97 of the toner retaining members 90A and 90B. When the transportation belt 12 keeps moving in the sheet transportation direction during the printing operation, the remaining toner 75 temporarily retained on the toner retaining surfaces 97 of the toner retaining members 90A and 90B slips away from the toner retaining members 90A and 90B, and adheres to the surface of the transportation belt 12 one more time, thereby moving with the surface of the transportation belt 12 toward the downstream side in the sheet transportation direction. Accordingly, the remaining toner 75 on the surface of the transportation belt 12 is repeatedly collected and supplied back to the surface of the transportation belt 12 at the toner retaining surfaces 97 of the toner retaining members 90A and 90B.

When the remaining toner 75 on the transportation belt 12 passes through the toner retaining members 90A and 90B, a part of the remaining toner 75 is not retained in the toner retaining members 90A and 90B, and moves with the surface of the transportation belt 12 in the moving direction of the transportation belt 12, i.e., toward the downstream side in the sheet transportation direction. In the embodiment, the cleaning blade 71 is disposed on the downstream side in the sheet transportation direction. Accordingly, the cleaning blade 71 scrapes off the remaining toner 75 passing through the toner retaining members 90A and 90B. In this case, when the cleaning blade 71 scrapes off the remaining toner 75, the remaining toner 75 drops into the waste toner case 81 to be retained as waste toner.

When the cleaning blade 71 scrapes off the remaining toner 75 on the transportation belt 12, the remaining toner 75 adheres to the abutting surface between the transportation belt 12 and the cleaning blade 71. In this case, the remaining toner 75 adhering to the abutting surface reduces a frictional load between the surface of the transportation belt 12 and the remaining toner 75, thereby preventing the cleaning blade 71 from being curled up.

In the embodiment, when color shift correction is performed, it is possible to move the toner retaining members 90A and 90B to the positions covering the color shift correction image areas 71A and 71B in the width direction of the sheet. Accordingly, it is possible to actively collect and supply the remaining toner 75 used for color shift correction. In general, color shift correction is regularly performed when the image forming apparatus 1 is turned on, and a top cover is closed, or according to the count value of printed sheets. Accordingly, it is possible to regularly supply the remaining toner 75 to the toner retaining members 90A and 90B.

It is possible to determine a width of the sheet from information from the host device such as printer driver provided as a part of a command of image data. It is possible to move the toner retaining members 90A and 90B to arbitrary positions according to a width of the sheet. That is, when the drive gear 111 is driven for a certain amount according to the information regarding a width of the sheet, the toner retaining members 90A and 90B move in the arrow directions 115*a* and 115*b* with rotations of the drive shaft 112. With this configuration, it is possible to move the toner retaining members 90A and 90B to arbitrary positions.

Figure 17:
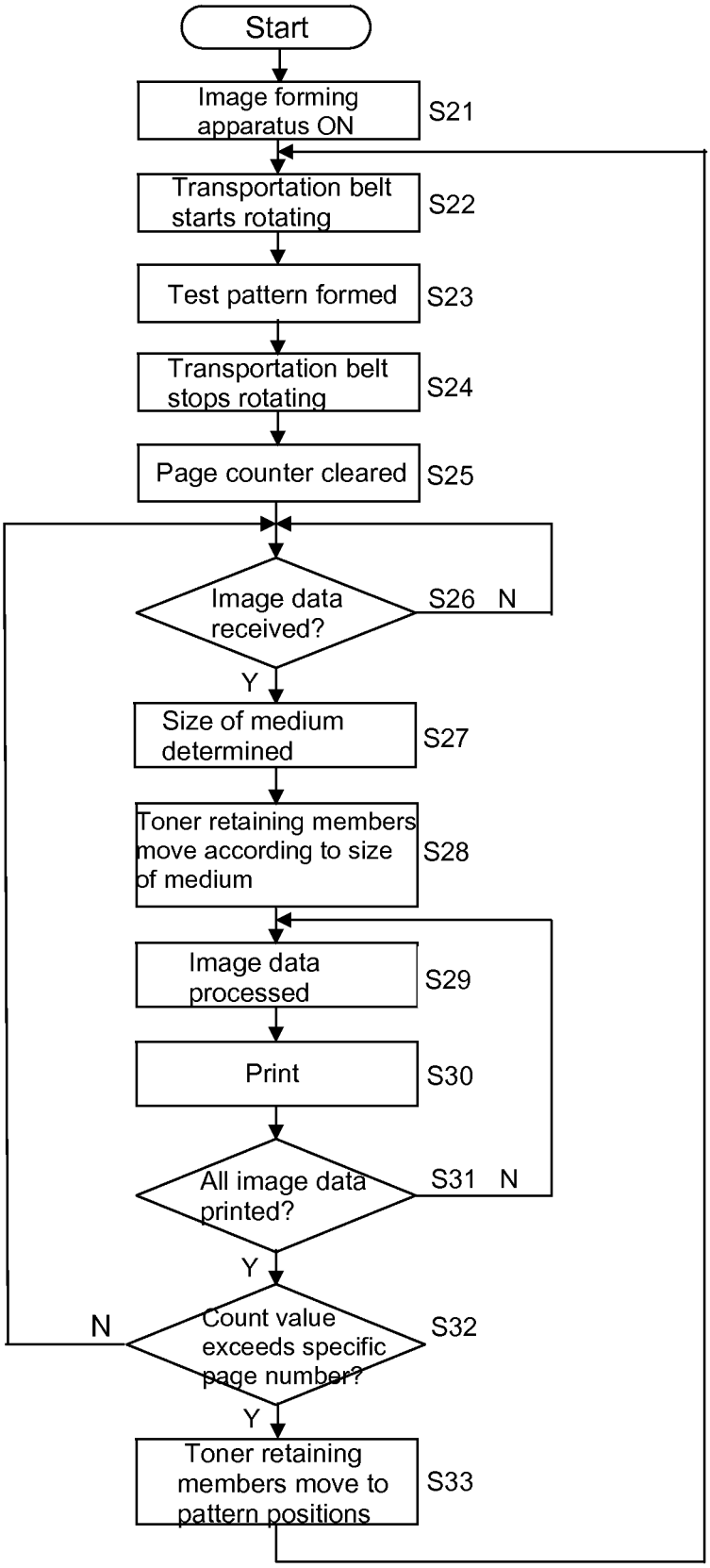
FIG. 17 is a flowchart showing an operation of the image forming apparatus according to the third embodiment of the present invention.

An operation of moving the toner retaining members 90A and 90B according to a size of the sheet will be explained next. FIG. 17 is a flowchart showing an operation of the image forming apparatus 1 according to the third embodiment of the present invention.

In the first step, the image forming apparatus 1 is turned on and the image forming apparatus 1 starts the initial operation, so that the transportation belt 12 starts rotating. In the next step, the control unit 44 forms the test patterns on the transportation belt 12 using print data of the test patterns for color shift correction stored in an internal memory in advance. Accordingly, color shift correction is performed. At this time, the toner retaining members 90A and 90B are located at positions where the test patterns for color shift correction are formed. After color shift correction is performed, the transportation belt 12 stops rotating. Then, the page counter 44*a* is cleared.

In the next step, the control unit 44 determines whether the command and the image data are received from the host device through the interface 41. When the command and the image data are not received, the control unit 44 repeatedly determines whether the command and the image data are received. When the command and the image data are received, the command image processing unit 42 analyzes the command thus received, and the control unit 44 determines a size of the sheet from a analysis result of the command.

In the next step, the control unit 44 drives the drive gear 111 according to the size of the sheet, so that the toner retaining members 90A and 90B move to positions on the transportation belt 12 corresponding to side edges of the sheet, that is, the toner retaining members 90A and 90B move according to the size of the sheet. Then, the command image processing unit 42 processes and converts the image data to printable data per page according to the command thus received. At this time, the control unit 44 increases the page counter 44*a* by one after the image data are processed for one page.

In the next step, the control unit 44 performs the printing operation. Then, the control unit 44 determines whether the print job is completed, that is, all of the image data are printed. When the print job is not completed, the image processing and the printing operation are repeated. When the print job is completed, the control unit 44 compares a specific page number stored in an internal memory in advance, for example, 100, with the count value of the page counter 44*a* upon completing the print job.

In the next step, when the count value exceeds the specific page number, the control unit 44 moves the toner retaining members 90A and 90B to positions where the test patterns for color shift correction are formed. At this time, when next image data are received, the next image data are temporarily stored in a data storage unit (not shown). After color shift correction is performed, the next image data are retrieved from the data storage unit for the image processing. When the count value is below the specific page number, the next image data are received.

The flowchart shown in FIG. 17 will be explained next. In step S21, the image forming apparatus 1 is turned on. In step S22, the transportation belt 12 starts rotating. In step S23, the test patterns are formed, and color shift correction is performed. In step S24, the transportation belt 12 stops rotating.

In step S25, the page counter 44*a* is cleared. In step S26, it is determined whether the command and the image data are received. When the command and the image data are received, the process proceeds to step S27. When the command and the image data are not received, it is repeatedly determined whether the command and the image data are received.

In step S27, the size of the medium is determined. In step S28, the toner retaining members 90A and 90B move according to the size of the medium. In step S29, the image data are processed per page and converted to the printable data. In step S30, the printing operation is performed.

In step S31, it is determined whether all of the image data are printed. When all of the image data are printed, the process proceeds to step S32. When all of the image data are not printed, the process returns to step S29. In step S32, it is determined whether the count value exceeds the specific page number. When the count value exceeds the specific page number, the process proceeds to step S33. When the count value does not exceed the specific page number, the process returns to step S26. In step S33, the toner retaining members 90A and 90B move to positions where the test patterns for color shift correction are formed, and the process returns to step S23.

As described above, in the embodiment, when color shift correction is performed, it is possible to move the toner retaining members 90A and 90B to the positions where the test patterns for color shift correction are formed. When the printing operation is performed, it is possible to move the toner retaining members 90A and 90B to the side edges of the sheet. Accordingly, it is possible to actively collect and supply the remaining toner 75 used for color shift correction.

Further, a long sheet in a continuous business form such as a label in a roll shape may have a narrow width or an unstable width. When such a sheet having a same width is continuously printed, the cleaning blade 71 tends to be easily curled up. In the embodiment, it is possible to prevent the cleaning blade 71 from being curled up in such an occasion.

The disclosure of Japanese Patent Applications No. 2006-342201, filed on Dec. 20, 2006, is incorporated in the application by reference.

While the invention has been explained with reference to the specific embodiments of the invention, the explanation is illustrative and the invention is limited only by the appended claims.

What is claimed is:

1. An image forming apparatus, comprising:

a toner supporting member for supporting toner or transporting a medium with a toner image formed thereon;

a cleaning member disposed to abut against the toner supporting member for removing the toner adhering to the toner supporting member; and a toner retaining member disposed on an upstream side of the cleaning member in a direction that the medium is transported and disposed to abut against the toner supporting member for scraping off and temporarily retaining the toner, said toner retaining member including a first toner retaining portion and a second toner retaining portion each respectively arranged on each side of a center line of the toner supporting member along the direction with a specific distance therebetween, said first toner retaining portion and said second toner retaining portion being arranged to contact with the toner supporting member.

2. The image forming apparatus according to claim 1, wherein said first toner retaining portion and said second toner retaining portion are arranged to be away from the center line.

3. The image forming apparatus according to claim 1, wherein said first toner retaining portion and said second toner retaining portion are arranged to be substantially symmetrical with respect to the center line.

4. The image forming apparatus according to claim 1, wherein at least one of said first toner retaining portion and said second toner retaining portion includes a substantially rectangular shaped portion.

5. The image forming apparatus according to claim 1, wherein said toner retaining member includes a surface contacting with a surface of the toner supporting member and extending in parallel to the surface of the toner supporting member.

6. The image forming apparatus according to claim 1, wherein said cleaning member is formed of a cleaning blade.

7. The image forming apparatus according to claim 1, wherein said toner supporting member is formed of a belt member.

8. The image forming apparatus according to claim 1, wherein said toner retaining member is arranged to supply the toner temporarily retained therein to the cleaning member.

9. The image forming apparatus according to claim 1, wherein said toner retaining member is arranged to be movable.

10. The image forming apparatus according to claim 9, wherein said toner retaining member is arranged to be movable in a direction perpendicular to a moving direction of the toner supporting member.

11. The image forming apparatus according to claim 1, further comprising a guide portion for guiding the toner retaining member to be movable in a direction perpendicular to a moving direction of the toner supporting member.

12. The image forming apparatus according to claim 11, wherein each of said first toner retaining portion and said second toner retaining portion includes a slider portion for engaging with the guide portion.

13. An image forming apparatus, comprising:

a toner supporting member for supporting toner or transporting a medium with a toner image formed thereon;

a cleaning member disposed to abut against the toner supporting member for removing the toner adhering to the toner supporting member;

a supporting member; and a toner retaining member supported on the supporting member and disposed on an upstream side of the cleaning member in a direction that the medium is transported to abut against the toner supporting member for scraping off and temporarily retaining the toner, said toner retaining member including a first surface contacting with a surface of the toner supporting member and extending in parallel to the surface of the toner supporting member, said toner retaining member including a second surface opposite to the first surface and contacting with the supporting member.

14. The image forming apparatus according to claim 13, wherein said toner supporting member includes a medium transportation belt unit.

15. The image forming apparatus according to claim 13, wherein said toner retaining member includes a sponge member.

16. The image forming apparatus according to claim 13, wherein said cleaning member is formed of a cleaning blade.

17. The image forming apparatus according to claim 13, wherein said toner retaining member is arranged to supply the toner temporarily retained therein to the cleaning member.

18. The image forming apparatus according to claim 13, wherein said toner retaining member is arranged to extend in a direction in parallel to a moving direction of the toner supporting member.

19. The image forming apparatus according to claim 13, wherein said toner retaining member is, sandwiched between the toner supporting member and the supporting member.

* * * * *